US011851987B2

(12) United States Patent
Zimmerman, Sr. et al.

(10) Patent No.: US 11,851,987 B2
(45) Date of Patent: Dec. 26, 2023

(54) OBSTRUCTION RELIEF IN SUBTERRANEAN WELLBORES

(71) Applicant: Chevron U.S.A. Inc., San Ramon, CA (US)

(72) Inventors: Patrick James Zimmerman, Sr., Houston, TX (US); Robert Sword Avent, Houston, TX (US); Harold Gordon Riordan, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 63 days.

(21) Appl. No.: 17/547,846

(22) Filed: Dec. 10, 2021

(65) Prior Publication Data

US 2022/0186586 A1 Jun. 16, 2022

Related U.S. Application Data

(60) Provisional application No. 63/123,964, filed on Dec. 10, 2020.

(51) Int. Cl.
*E21B 34/14* (2006.01)
*E21B 34/06* (2006.01)

(52) U.S. Cl.
CPC ..... *E21B 34/14* (2013.01); *E21B 34/063* (2013.01)

(58) Field of Classification Search
CPC ..... E21B 34/14; E21B 34/063; E21B 37/00
See application file for complete search history.

(56) References Cited

U.S. PATENT DOCUMENTS

| | | | | |
|---|---|---|---|---|
| 4,392,377 | A * | 7/1983 | Rankin | E21B 49/087 250/254 |
| 6,026,903 | A * | 2/2000 | Shy | E21B 34/063 166/292 |
| 7,665,545 | B2 * | 2/2010 | Telfer | E21B 21/10 175/57 |
| 10,041,333 | B2 * | 8/2018 | Hern | E21B 37/02 |
| 11,428,071 | B2 * | 8/2022 | Hiorth | E21B 34/063 |
| 2005/0217866 | A1 * | 10/2005 | Watson | E21B 43/103 166/207 |
| 2007/0095573 | A1 * | 5/2007 | Telfer | E21B 34/14 175/57 |
| 2012/0138297 | A1 * | 6/2012 | Johnson | E21B 33/14 166/285 |
| 2021/0040816 | A1 * | 2/2021 | Hiorth | E21B 34/063 |
| 2022/0268114 | A1 * | 8/2022 | Egbe | E21B 34/103 |

* cited by examiner

*Primary Examiner* — Steven A MacDonald
(74) *Attorney, Agent, or Firm* — Smith & Woldesenbet Law Group, PLLC

(57) ABSTRACT

An obstruction relief tool can include a plurality of walls that includes an inner wall, where the inner wall forms a cavity along a length of the inner wall. The obstruction relief tool can also include a chamber disposed between the plurality of walls, where the chamber has a proximal end and a distal end. The obstruction relief tool can further include an actuation device that is configured to actuate when an obstruction is within the cavity, where the actuation device, when actuated, is configured to open a first aperture in the inner wall that leads to the proximal end of the chamber, where the distal end of the chamber leads to a second aperture in the inner wall, where the first aperture is adjacent to the cavity above the obstruction, and where the second aperture in the inner wall is adjacent to the cavity below the obstruction.

20 Claims, 13 Drawing Sheets

OBSTRUCTION RELIEF IN SUBTERRANEAN WELLBORES

CROSS-REFERENCE TO RELATED APPLICATIONS

This application claims priority under 35 U.S.C. § 119 to U.S. Provisional Patent Application Ser. No. 63/123,964 titled "Obstruction Relief in Subterranean Wellbores" and filed on Dec. 10, 2020, the entire contents of which are hereby incorporated herein by reference.

TECHNICAL FIELD

The present application relates generally to managing subterranean wellbore operations, particularly when obstructions (e.g., from debris) affect the field operations.

BACKGROUND

In the current art, fluid loss valves (FLVs) are often used in a completion when a lower completion has been properly placed and stimulated. A typical FLV includes a ball valve, a remote actuation mechanism, and a contingency mechanical shifting profile. A common problem that arises is that debris accumulates on top of the ball, thereby blocking communication with the remote actuation mechanism. By preventing the pressure to extend through the debris, the FLV does not actuate.

SUMMARY

In general, in one aspect, the disclosure relates to an obstruction relief tool. The obstruction relief tool can include a plurality of walls that includes an inner wall, where the inner wall of the plurality of walls forms a cavity along a length of the inner wall. The obstruction relief tool can also include a chamber disposed between the plurality of walls, where the chamber has a proximal end and a distal end. The obstruction relief tool can further include an actuation device that is configured to actuate when an obstruction is within the cavity, where the actuation device, when actuated, is configured to open a first aperture in the inner wall that leads to the proximal end of the chamber, where the distal end of the chamber leads to a second aperture in the inner wall, where the first aperture is adjacent to the cavity above the obstruction, and where the second aperture in the inner wall is adjacent to the cavity below the obstruction.

In another aspect, the disclosure relates to method for delivering a fluid to a tool below an obstruction in a cavity of a tubing string in a subterranean wellbore. The method can include actuating, upon the presence of the obstruction within a cavity of an obstruction relief tool, an actuation device of the obstruction relief tool disposed within the subterranean wellbore, where actuating the actuation device opens a flowpath for the fluid from a cavity through a first aperture at a proximal end of the obstruction relief tool, through a chamber, and through a second aperture at a distal end of the obstruction relief tool into the cavity for the tool, where the first aperture is above the obstruction, and where the second aperture is below the obstruction.

In yet another aspect, the disclosure relates to an assembly disposed within a subterranean wellbore. The assembly can include a tool and an obstruction relief tool coupled to a tube pipe of a tubing string, where the obstruction relief tool, when enabled, relieves an obstruction in a cavity in the obstruction relief tool to provide a fluid to the tool, where the obstruction affects flow of the fluid through the cavity to the tool, and where the tool is disposed below the obstruction relief tool in the subterranean wellbore.

These and other aspects, objects, features, and embodiments will be apparent from the following description and the appended claims.

BRIEF DESCRIPTION OF THE DRAWINGS

The drawings illustrate only example embodiments of systems and devices for obstruction relief in a subterranean wellbore and are therefore not to be considered limiting of its scope, as obstruction relief in a subterranean wellbore may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DESCRIPTION OF EXAMPLE EMBODIMENTS

Figure 1:
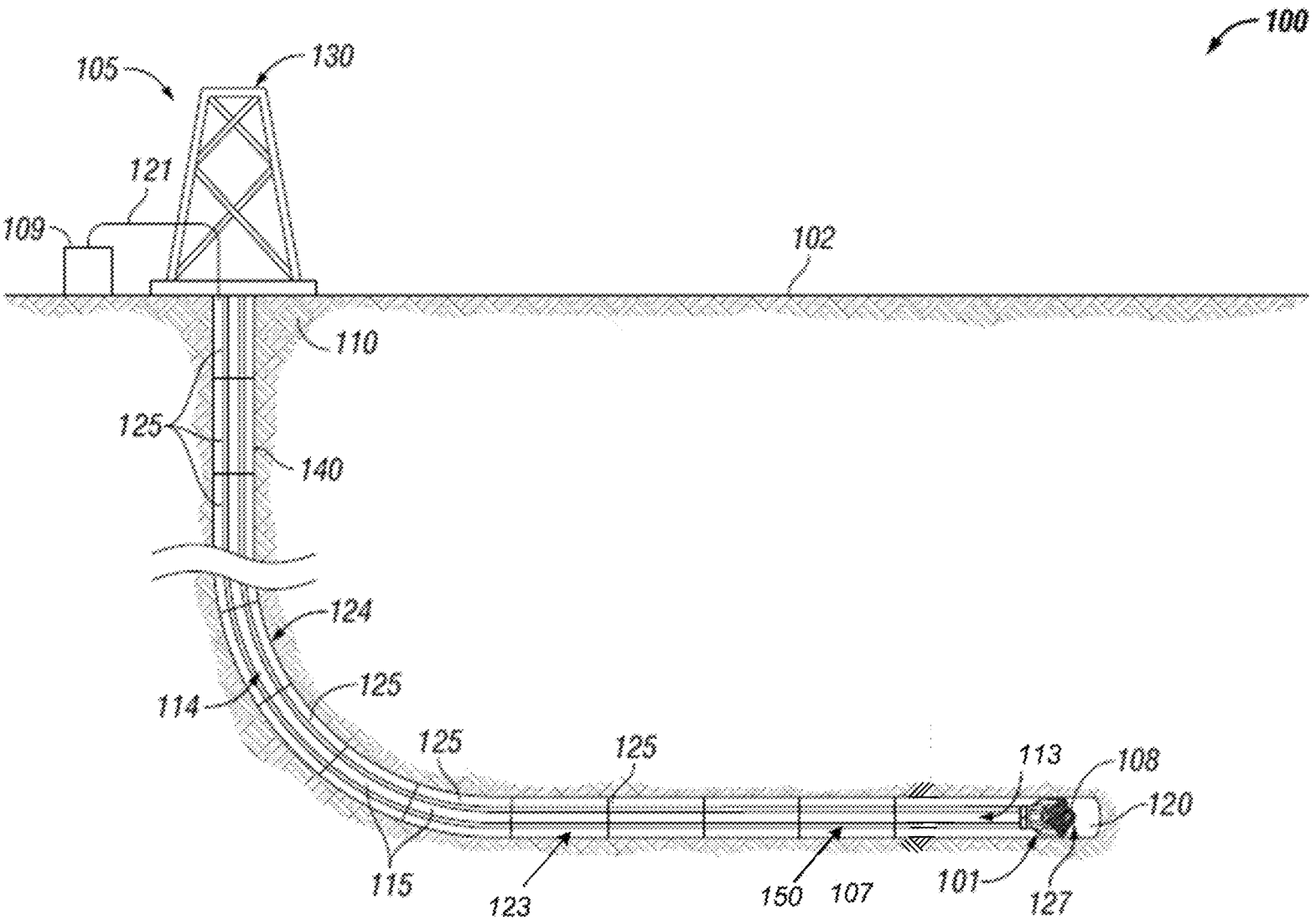
FIG. 1 shows a schematic diagram of a field system with a subterranean wellbore in which example embodiments can be used.

The example embodiments discussed herein are directed to systems, methods, and devices for relieving obstructions in subterranean wellbores. While example embodiments are described herein as being used to relieve obstructions in subterranean formations (e.g., subterranean wellbores), example embodiments can also be used to relieve obstructions in any other type of environment where long pipe and piping strings are involved. Such other environments can include, but are not limited to, a subsea operation. Also, while example embodiments are designed for harsh (e.g., high temperature, high pressure) environments, example embodiments can also be used in any other type of environment (e.g., hazardous, non-hazardous, low temperature, corrosive, high vibration).

Tools that are subject to obstructions that can be relieved using example embodiments can be used in one or more different subterranean operations. For example, a tool can be a FLV. In such a case, during a completion operation, debris can accumulate above the FLV to prevent the FLV from operating properly because of a lack of pressure needed to actuate the FLV. In such a case, enough of the debris must be cleared before the completion operation can resume, which is costly in terms of time and expense. As defined herein, the term "obstruction relief" and similar terms (e.g., "relief of an obstruction") are stated with respect to a field operation and is not necessarily meant to imply that a downhole obstruction is physically cleared. In some cases, an obstruction is bypassed using example embodiments, and so the field operation can continue (is relieved of the obstruction) without having to physically remove the downhole obstruction. In other cases, a downhole obstruction (e.g., debris) is physically removed using example embodiments, thereby relieving the obstruction both in terms of the operation and in terms of the physical obstruction itself.

A user as described herein may be any person that is involved with a subterranean wellbore, including field operations (e.g., completion, exploration, production) thereof. Examples of a user may include, but are not limited to, a roughneck, a company representative, a drilling engineer, a tool pusher, a service hand, a field engineer, an electrician, a mechanic, an engineering services company, an operator, a consultant, a contractor, and a manufacturer's representative. A user can include a user system (e.g., a smart phone, a laptop computer, an electronic tablet) for communication, control, data collection, reporting, and/or other applicable functions.

Example embodiments can be used in any of a number of field operations. For example, example embodiments can be used in a case where a rig is on location, and the FLV is opened by applying pressure from the rig. In such a case, subsequent well operations can occur before the well can be put on production. This example commonly occurs in the oilfield industry. As another example, example embodiments can be used in a case where a rig leaves the location, the well is completed, and the FLV is closed. In such a case, the FLV is opened from a host (e.g., FPU, FPSO, Fixed platform). This example is used on occasion with subsea developments in the oilfield industry. In both cases, example embodiments can reduce risk by relieving obstructions that may develop downhole during such field operations.

Any example system for obstruction relief in a subterranean wellbore, or portions (e.g., components) thereof, described herein can be made from a single piece (as from a mold or extrusion). When an example system (or portion thereof) for obstruction relief in a subterranean wellbore is made from a single piece, the single piece can be cut out, bent, stamped, and/or otherwise shaped to create certain features, elements, or other portions of a component. Alternatively, an example system (or portions thereof) for obstruction relief in a subterranean wellbore can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, abut against, fasten, and/or perform other functions aside from strictly coupling. In addition, each component and/or feature described herein (including each component of an example system for relieving obstructions in a subterranean wellbore) can be made of one or more of a number of suitable materials, including but not limited to metal (e.g., stainless steel), ceramic, rubber, glass, and plastic.

A coupling feature (including a complementary coupling feature) as described herein can allow one or more components and/or portions of an example assembly to become mechanically coupled, directly or indirectly, to another portion of the assembly, to another component (e.g., a FLV) of the system and/or another component of a bottom hole assembly (BHA) or tubing string. A coupling feature can include, but is not limited to, a portion of a hinge, an aperture, a recessed area, a protrusion, a slot, a spring clip, a tab, a detent, and mating threads. One portion of an example assembly can be coupled to another portion of the assembly and/or another component of a BHA or tubing string by the direct use of one or more coupling features.

In addition, or in the alternative, a portion of an example system for obstruction relief in a subterranean wellbore can be coupled to another portion of the system for obstruction relief in a subterranean wellbore and/or another component of a BHA or tubing string using one or more independent devices that interact with one or more coupling features disposed on a component of the system for obstruction relief in a subterranean wellbore. Examples of such devices can include, but are not limited to, a pin, a hinge, a fastening device (e.g., a bolt, a screw, a rivet), an adapter, and a spring. One coupling feature described herein can be the same as, or different than, one or more other coupling features described herein. A complementary coupling feature as described herein can be a coupling feature that mechanically couples, directly or indirectly, with another coupling feature.

When used in certain systems (e.g., subterranean field operations), example embodiments can be designed to help such systems comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA).

If a component of a figure is described but not expressly shown or labeled in that figure, the label used for a corresponding component in another figure can be inferred to that component. Conversely, if a component in a figure is labeled but is not described, the description for such component can be substantially the same as the description for the corresponding component in another figure. The numbering scheme for the various components in the figures herein is such that each component is a three-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of systems for obstruction relief in a subterranean wellbore will be described more fully hereinafter with reference to the accompanying drawings, in which example embodiments of systems for obstruction relief in a subterranean wellbore are shown. Systems for obstruction relief in a subterranean wellbore may, however, be embodied in many different forms and should not be construed as limited to the example embodiments set forth herein. Rather, these example embodiments are provided so that this disclosure will be thorough and complete, and will fully convey the scope of systems for obstruction relief in a subterranean wellbore to those of ordinary skill in the art. Like, but not necessarily the same, elements (also sometimes called components) in the various figures are denoted by like reference numerals for consistency.

Terms such as "first", "second", "outer", "inner", "above", "below", "top", "bottom", "upper", "lower", "left", "right", "front", "rear", "distal", "proximal", "end", "side", "on", and "within", when present, are used merely to distinguish one component (or part of a component or state of a component) from another. Also, terms such as "enabled", "engaged", and "actuated" can be used interchangeably herein, and terms such as "disabled", "disengaged", and "de-actuated" can be used interchangeably herein. This list of terms is not exclusive. Such terms are not meant to denote a preference or a particular orientation, and they are not meant to limit embodiments of systems for obstruction relief in a subterranean wellbore. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a schematic diagram of a land-based field system 100 in which assemblies 150 for relieving obstructions in a subterranean wellbore 120 can be used within a subterranean formation 110 in accordance with one or more example embodiments. Referring to FIG. 1, the field system 100 in this example includes the wellbore 120 that is formed by a wall 140 in the subterranean formation 110 using field equipment 130. The field equipment 130 can be located above a surface 102, and/or within the wellbore 120. The surface 102 can be ground level for an on-shore application and the sea floor for an off-shore application. The point where the wellbore 120 begins at the surface 102 can be called the entry point.

The subterranean formation 110 can include one or more of a number of formation types, including but not limited to shale, limestone, sandstone, clay, sand, and salt. In certain embodiments, the subterranean formation 110 can also include one or more reservoirs in which one or more subterranean resources (e.g., oil, gas, water, steam) can be located. One or more of a number of field operations (e.g., fracking, coring, tripping, drilling, setting casing, extracting downhole resources) can be performed to reach an objective of a user with respect to the subterranean formation 110. During these field operations, the tools 107 used in the wellbore 120 can, due to obstructions caused by accumulation of debris, become inoperable or otherwise inhibited, preventing a user (e.g., an operator) from opening the tool 107 inside the wellbore 120.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., insert casing pipe, extract downhole materials) the wellbore 120. The field equipment 130 can be positioned and/or assembled at the surface 102. The field equipment 130 can include, but is not limited to, a circulation unit 109 (including circulation line 121, as explained below), a derrick, a tool pusher, a clamp, a tong, drill pipe, a drill bit, example isolator subs, tubing housing (also sometimes called tubing pipe), a power source, and casing pipe.

The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of casing pipe to be inserted at a certain depth in the wellbore 120.

Inserted into and disposed within the wellbore 120 of FIG. 1 are a number of casing pipes 125 that are coupled to each other end-to-end to form the casing string 124. In this case, each end of a casing pipe 125 has mating threads (a type of coupling feature) disposed thereon, allowing a casing pipe 125 to be mechanically coupled to an adjacent casing pipe 125 in an end-to-end configuration. The casing pipes 125 of the casing string 124 can be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion 127 of the wellbore 120 extends beyond the casing string 124 at the distal end of the wellbore 120.

Each casing pipe 125 of the casing string 124 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of the casing pipe 125 is circular, the width can refer to an outer diameter, an inner diameter, or some other form of measurement of the casing pipe 125. Examples of a width in terms of an outer diameter can include, but are not limited to, 7 inches, 7⅝ inches, 8⅝ inches, 9⅝ inches, 9⅞ inches, 10¾ inches, 13⅜ inches, and 14 inches.

The size (e.g., width, length) of the casing string 124 can be based on the information gathered using field equipment 130 with respect to the wellbore 120. The walls of the casing string 124 have an inner surface that forms a cavity 113 that traverses the length of the casing string 124. Each casing pipe 125 can be made of one or more of a number of suitable materials, including but not limited to stainless steel. In certain example embodiments, each casing pipe 125 is made of one or more of a number of electrically conductive materials.

A number of tubing pipes 115 that are coupled to each other and inserted inside the cavity 113 form the tubing string 114. The collection of tubing pipes 115 can be called a tubing string 114. The tubing pipes 115 of the tubing string 114 are mechanically coupled to each other end-to-end, usually with mating threads (a type of coupling feature). The tubing pipes 115 of the tubing string 114 can be mechanically coupled to each other directly or using a coupling device, such as a coupling sleeve or an isolator sub (both not shown). Also disposed within and/or attached to a distal end of the tubing string 114 can be one or more example assemblies 150. In this example, there is one example assembly 150 disposed between the distal end of the tubing string 114 and the tool 107. In other cases, the assembly 150 and the tool 107 can be integrated with the tubing string 114.

Each tubing pipe 115 of the tubing string 114 can have a length and a width (e.g., outer diameter). The length of a tubing pipe 115 can vary. For example, a common length of a tubing pipe 115 is approximately 30 feet. The length of a tubing pipe 115 can be longer (e.g., 40 feet) or shorter (e.g., 10 feet) than 30 feet. Also, the length of a tubing pipe 115 can be the same as, or different than, the length of an adjacent casing pipe 125. The width of a tubing pipe 115 can also vary and can depend on one or more of a number of factors, including but not limited to the target depth of the wellbore 120, the total length of the wellbore 120, the inner diameter of the adjacent casing pipe 125, and the curvature of the wellbore 120.

The width of a tubing pipe 115 can refer to an outer diameter, an inner diameter, or some other form of measurement of the tubing pipe 115. Examples of a width in terms of an outer diameter for a tubing pipe 115 can include, but are not limited to, 7 inches, 5 inches, and 4 inches. In some cases, the outer diameter of the tubing pipe 115 can be such that a gap (an annulus) exists between the tubing pipe 115 and an adjacent casing pipe 125. The walls of the tubing pipe 115 have an inner surface that forms a cavity 123 that traverses the length of the tubing pipe 115. The tubing pipe 115 can be made of one or more of a number of suitable materials, including but not limited to steel.

At the distal end of the tubing string 114 within the wellbore 120 is an example assembly 150, followed by a BHA 101. The BHA 101 can include one or more of a number of components, including but not limited to a bit 108 at the far distal end, a tool 107 (e.g., a FLV), a measurement-while-drilling tool, one or more tubing pipes 115, and one or more stabilizers. During a field operation, the tubing string 114, including the BHA 101, can be rotated by other field equipment 130. During a field operation, the tool 107 is used to perform one or more of a number of operations (e.g., completion, fracturing within the subterranean wellbore). The tubing string 114, BHA 101 (which can include the tool 107 and/or the assembly 150), the tool 107, the example assembly 150, and any other components coupled to one or more of these components can generally be referred to herein as a downhole assembly or a wellbore assembly.

The circulation unit 109 can include one or more components that allow a user to control the one or more downhole components (e.g., a portion of the BHA 101, a part of the example assembly 150) from the surface 102. Examples of such components of the circulation unit 109 can include, but are not limited to, a compressor, one or more valves, a pump, piping, and a motor. The circulating line 121 transmits fluid (e.g., drilling mud, proppant) from the circulating unit 109 downhole to the tool 107 and/or the BHA 101 (including components thereof, such as the tool 107).

Figure 2:
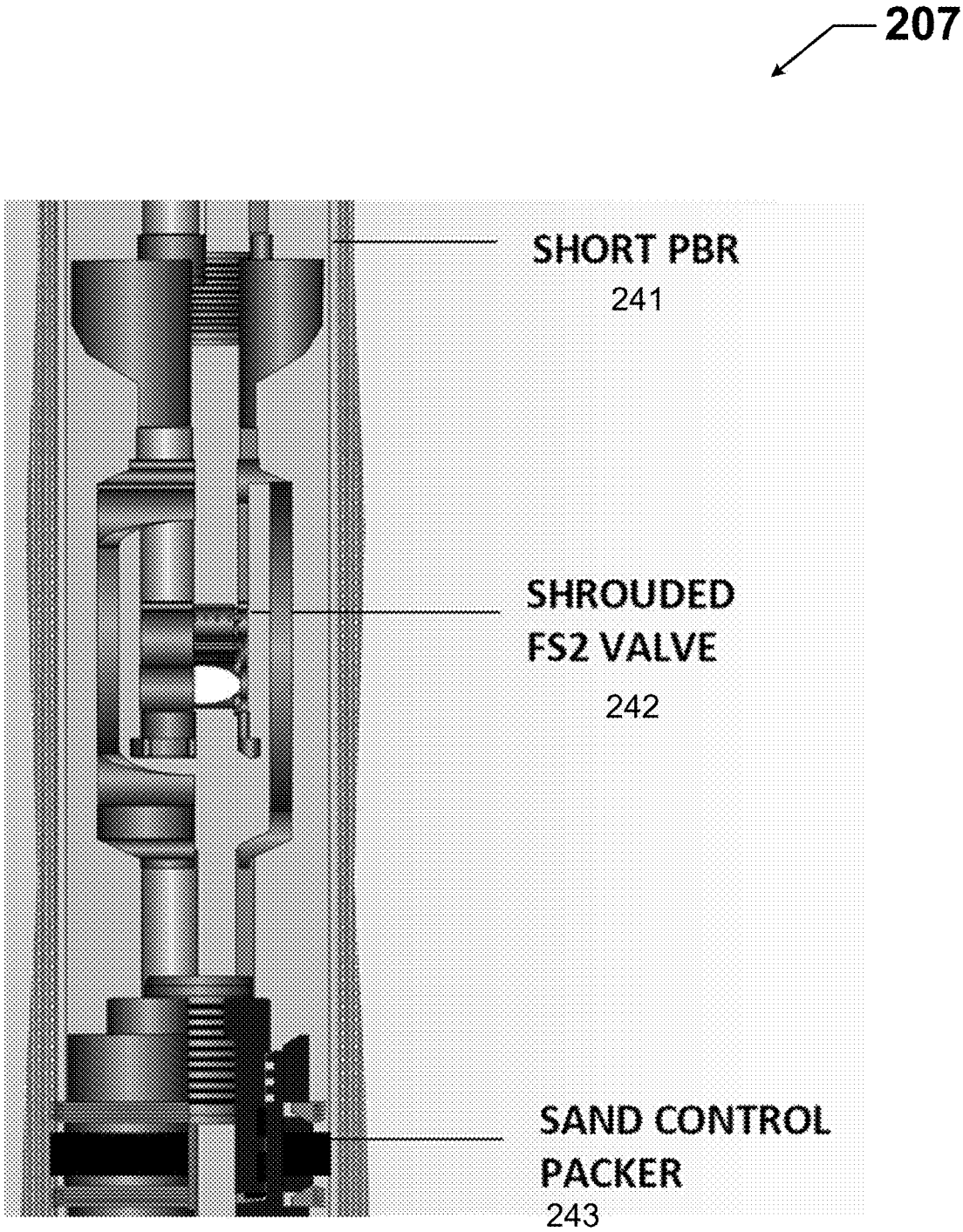
FIG. 2 (Prior Art)
FIG. 2 shows a cross-sectional side view of a tool currently used in the art.

FIG. 2 shows a cross-sectional side view of a tool 207 currently used in the art. Referring to FIGS. 1 and 2, the tool 207 of FIG. 2 is in the form of a FLV having, from top to bottom, a short polished bore receptacle (PBR) 241, a shrouded ball valve 242, and a sand control packer 243. Debris in the cavity 113 of the tubing string 114, of which the tool 207 can be a part, can accumulate and cause the tool 207 to mis-operate or fail altogether. Debris can be one or more of any of a number of components and/or materials related to a field operation. Examples of debris can include, but are not limited to, scale, pipe dope, proppant, rocks, sand, cuttings, and barite.

This tool 207 is typically used during completion operations, and so high hydrostatics are involved, making for optimal conditions for debris to accumulate and cause an obstruction. Also, the shroud of the ball valve 242 could be eliminated if the concern for obstructions were reduced or eliminated, which would result in a more efficient utilization of the ball valve 242. In this case, the tool 207 has a ball at the bottom and a port at the top, and the tool 207 can operate on pressure cycles. The accumulation of debris can cause any of a number of problems with the tool 207. Examples of such problems can include, but are not limited to, pre-mature opening events, failure to mechanically operate, and requiring additional cycles to remotely open. In severe cases, mechanical intervention (e.g., bailing runs, circulation clean-out trips) is required, which is costly in terms of time and resources.

Figure 3:
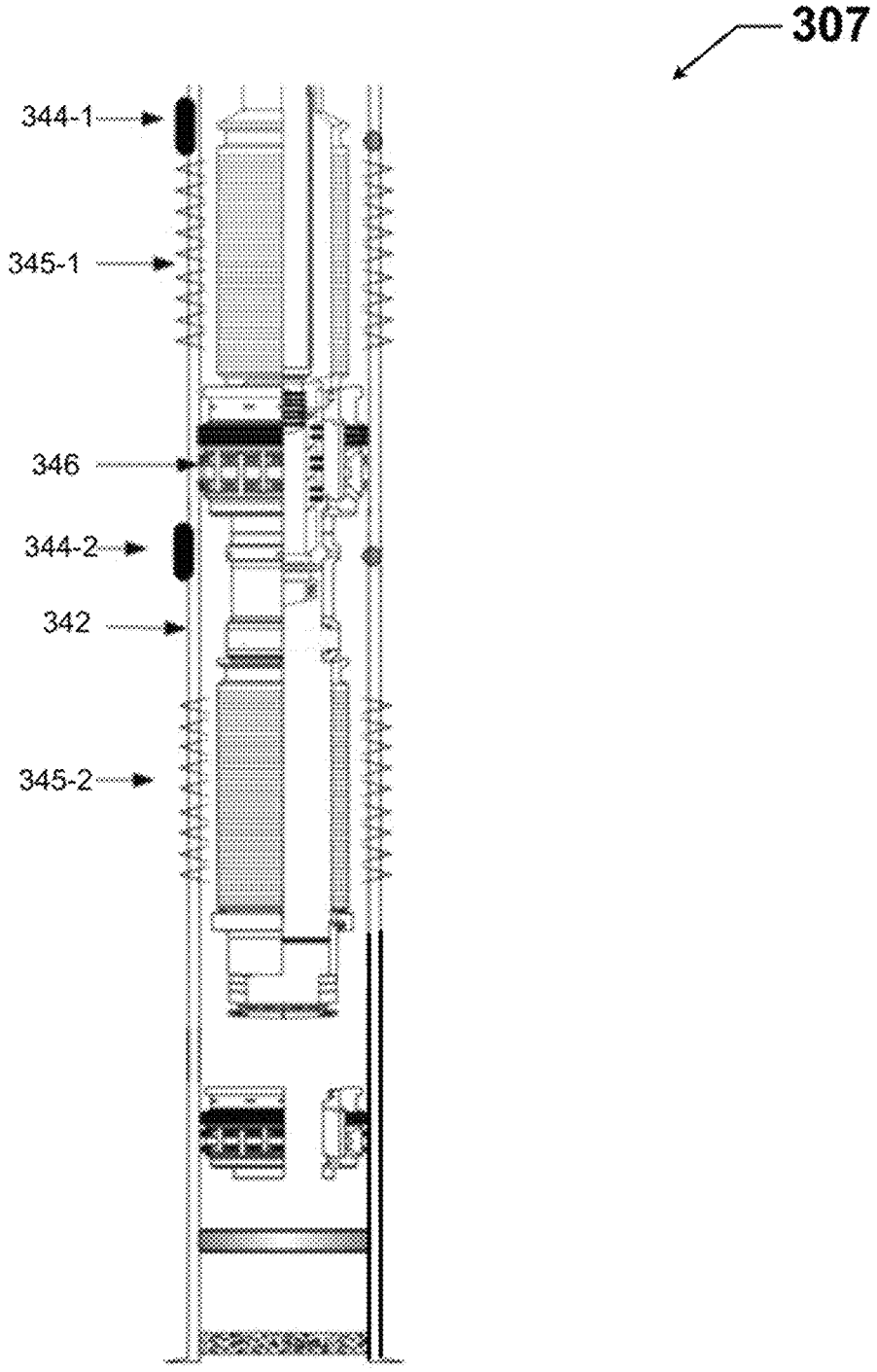
FIG. 3 (Prior Art)
FIG. 3 shows a cross-sectional side view of another tool currently used in the art.

FIG. 3 shows a cross-sectional side view of another tool 307 currently used in the art. In this case, the tool 307 includes, from top to bottom, a swell packer 344-1, a set of screens 345-1, a VCA packer 356, another swell packer 344-2, a ball valve 342, and another set of screens 345-2. This tool 307 is commonly used in fracturing operations. Again, the ball valve 342 can become non-operational or mis-operate when obstructions result from the accumulation of debris.

Figure 4A:
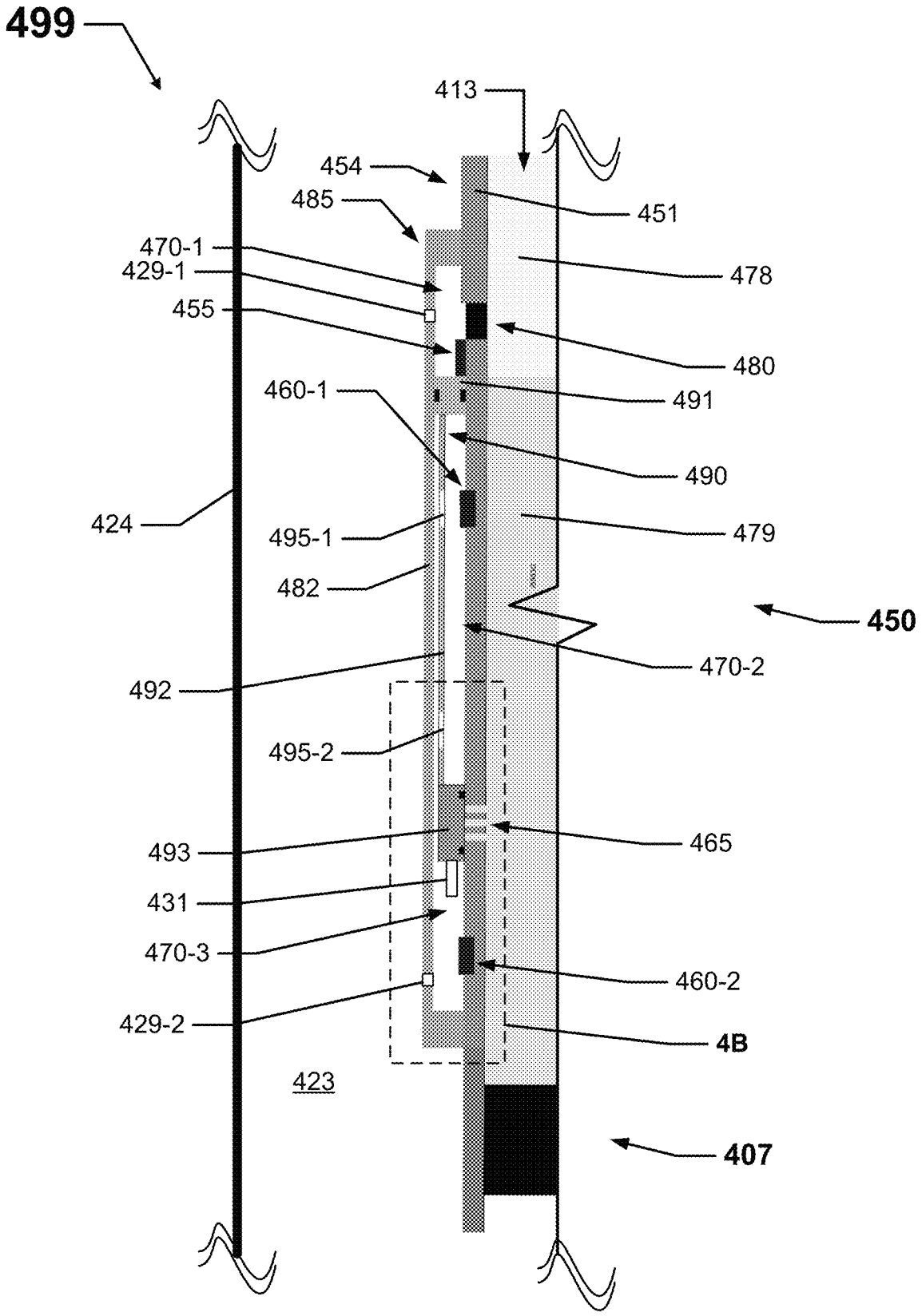
FIGS. 4A through 4C shows various cross-sectional side views of an assembly in accordance with certain example embodiments.
Figure 4B:
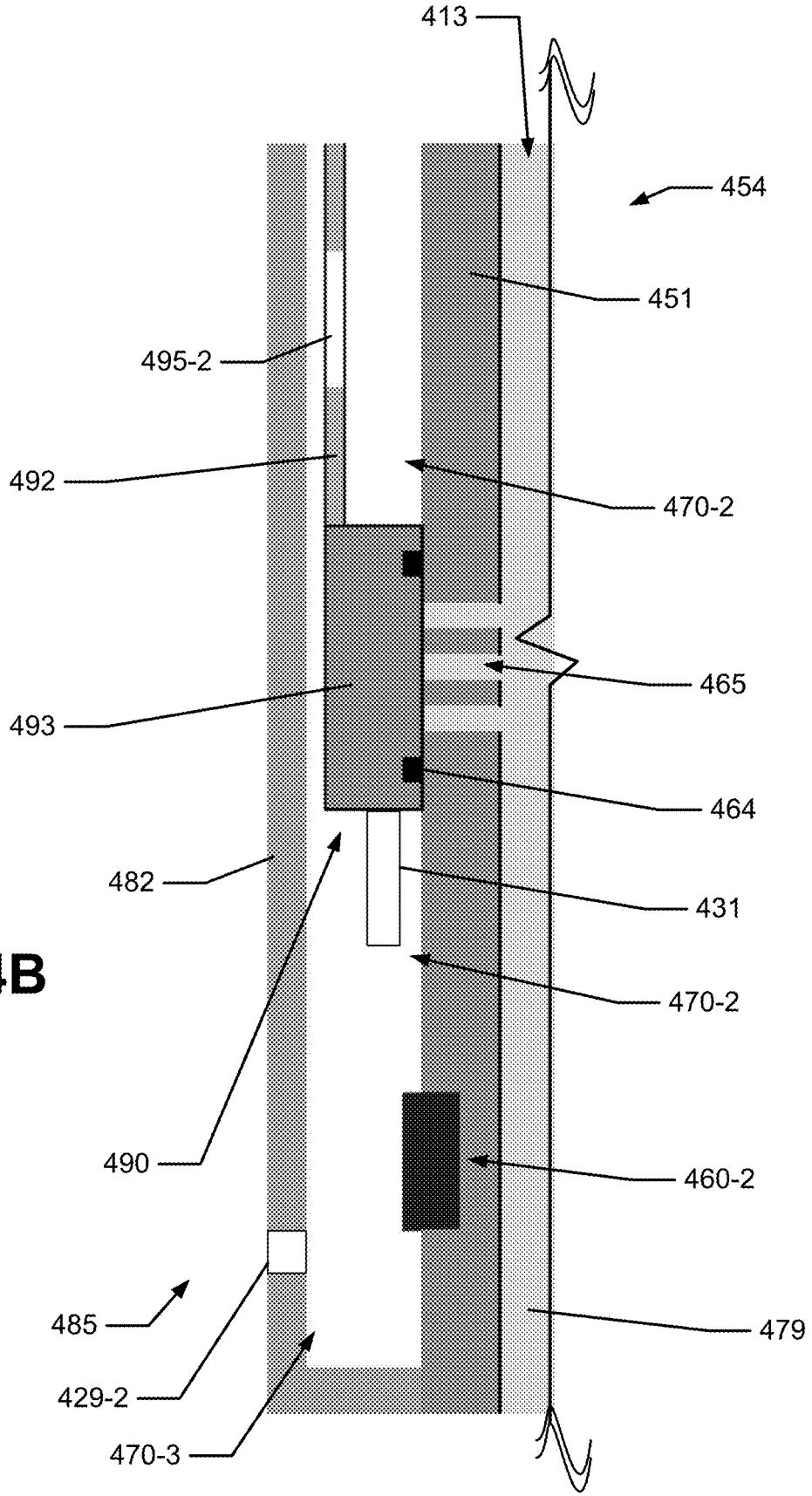
Figure 4C:
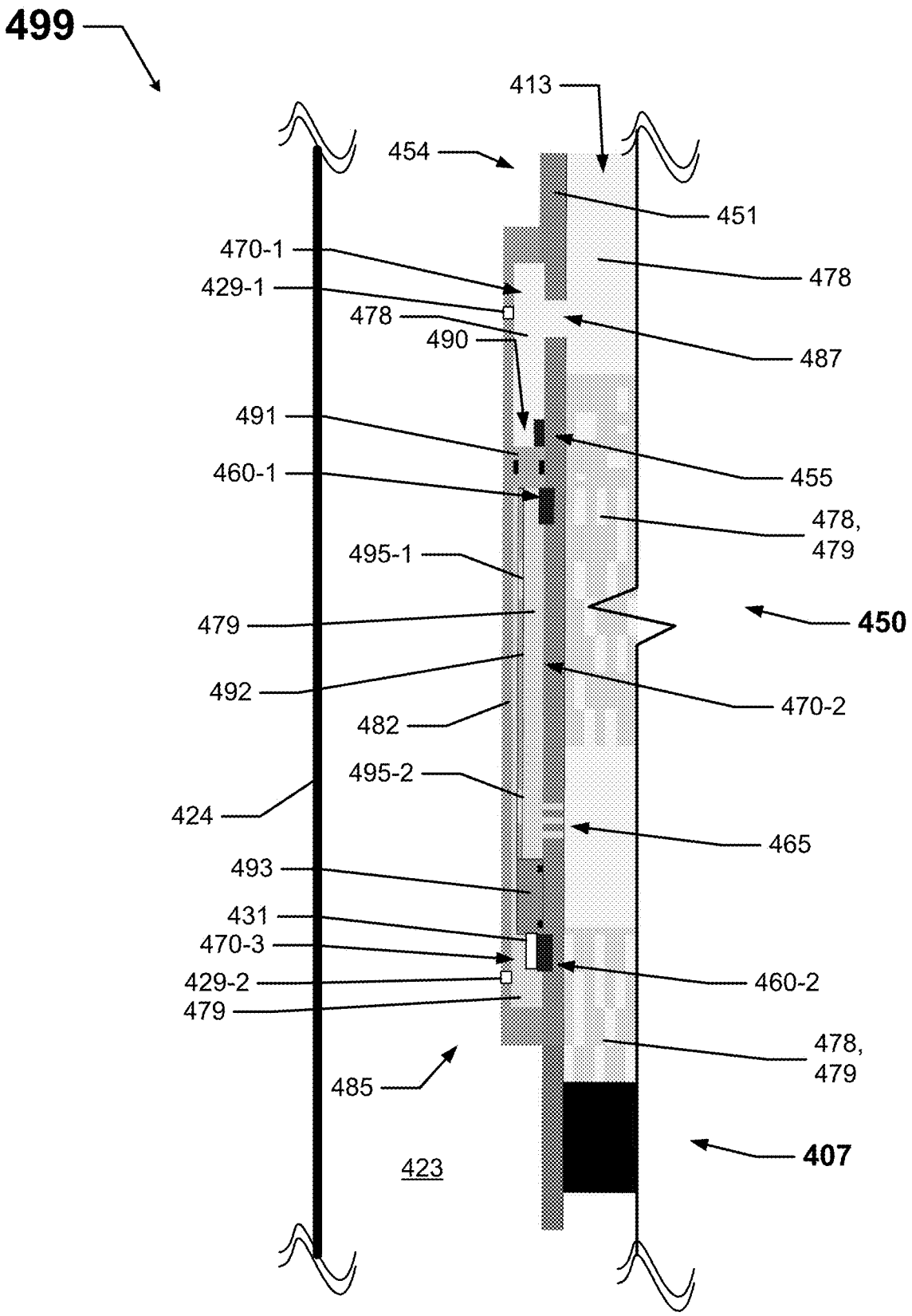

FIGS. 4A through 4C show various cross-sectional side views of an assembly 499 in accordance with certain example embodiments. Specifically, FIG. 4A shows a cross-sectional side view of the assembly 499 with an obstruction relief tool 450 in a disengaged state. FIG. 4B shows a detailed cross-sectional side view of part of the obstruction relief tool 450 of the assembly 499 of FIG. 4A. FIG. 4C shows a detailed cross-sectional side view of the assembly 499 with the obstruction relief tool 450 in an engaged state. Referring to FIGS. 1 through 4C, the assembly 499 in this case includes a tool 407 and the example obstruction relief tool 450 that are coupled (e.g., threadably) to each other in series. As stated above with respect to FIG. 1, the obstruction relief tool 450 can be coupled (e.g., threadably) to a tubing pipe 115 of the tubing string 114.

When placed in a wellbore 120, the obstruction relief tool 450 is located closer to the surface 102 than (upstream of) the tool 407 (e.g., a FLV). The tool 407 of FIGS. 4A through 4C is substantially the same as the tools discussed above with respect to FIGS. 1 through 3. The various components (e.g., housing 485, piston 490, mandrel 454, chamber 470-3) of the obstruction relief tool 450 can be disposed around some or all of the outer perimeter of the wall 451 of the mandrel 454. In some cases, there can be multiple instances of one or more of these components distributed (e.g., equidistantly, randomly) around the outer perimeter of the mandrel 454. When there are multiples of a component, one of them can be configured the same as, or differently than, at least one of the others.

As shown in FIGS. 4A and 4B, during a field operation (e.g., a completion operation) in a wellbore 120, a large amount of debris 479 has accumulated in the cavity 413 within the obstruction relief tool 450 and just above the tool 407. The build-up of debris 479 forms an obstruction in the cavity 413 that prevents fluid 478 (e.g., completion fluid) from reaching the tool 407, which can reduce or prevent the operational viability of the tool 407. The example obstruction relief tool 450 can bypass, reduce, or eliminate the debris 479, allowing the fluid 478 to reach the tool 407 at a proper flow rate (or at least a stronger flow rate) to allow the tool 407 to operate properly and the field operation to proceed.

There are many ways in which an example obstruction relief tool 450 can relieve the obstruction caused by the debris 479. In this case, debris 479 accumulates in the cavity 413 within the mandrel 454 of the obstruction relief tool 450. As the fluid 478 is pumped downhole, the debris 479, prevents the fluid 478 from freely flowing through the cavity 413 of the mandrel 454 of the obstruction relief tool 450. When the pressure caused by the fluid 478 within the cavity 413 reaches a threshold value, the actuation device 480 actuates (e.g., opens, breaks apart). As a result, some of the fluid 478 flows from the cavity 413 into the chamber 470-1. When enough fluid 478 flows into the chamber 470-1, the fluid forces the piston 490 to move downward.

As the piston 490 moves downward, the distal end 493 of the piston 490 stops covering (opens) the channels 465 (also sometimes called flow ports 465, pathways 465, or apertures 465 herein) in the wall 451 of the mandrel 454. When the channels 465 in the wall 451 of the mandrel 454 are opened, the downward force of the fluid 478 within the cavity 413 forces some of the debris 479 from the cavity 413 to move into the chamber 470-2 formed within the piston 490, thereby dissipating the debris 479 within the cavity 413 so that more of the fluid 478 can mix with the debris 479 in the cavity 413 and relieve the obstruction.

The example obstruction relief tool 450 can have any of a number of configurations for removing some or all of the debris 479 to allow the fluid 478 to reach the tool 407. For example, the obstruction relief tool 450 of the assembly 499 of FIGS. 4A through 4C can include a base cylinder 454 (e.g., a mandrel 454) formed by a wall 451, a housing 485 that extends outward from some or all of the wall 451 of the mandrel 454, and a piston 490 that is movably disposed within the housing 485. The piston 490 includes the distal end 493, an outer wall 492, and a proximal wall 491, all of which form the chamber 470-2 with the outer surface of the wall 451 of the mandrel 454.

The housing 485 has one or more housing walls 482, at least one of which abuts against the wall 451 of the mandrel 454 to form at least one chamber 470. Specifically, in this case, there are three separate chambers 470 within the housing 485. Chamber 470-1 is disposed at the proximal end (furthest away from the tool 407) of the housing 485, partially bounded by the piston 490. Chamber 470-2 is disposed within the piston 490, which is partially bounded by the wall 451 of the mandrel 454. Chamber 470-3 is partially disposed at the distal end (closest to the tool 407) of the housing 485, between the wall 482 of the housing 485 and the outer wall 492 and the distal wall 493 of the piston 490. In some cases, as when the flow port 495-1 and/or the flow port 495-2 are always open, the chamber 470-2 and the chamber 470-3 can be considered as a single chamber 470.

In certain example embodiments, each of these chambers 470 is pressurized at atmospheric pressure (approximately 14.7 psi). As a result, the chambers 470 are at a relatively low pressure compared to the relatively high hydrostatic pressure caused by the fluid 478 as a result of the debris 479 that has accumulated in the cavity 413. Consequently, when the pressure in the cavity 413 is high enough, the fluid 478 actuates the actuation device 480 in an effort to equalize the pressure in the chamber 470-1.

In alternative embodiments, one or more of the chambers 470 (e.g., chamber 470-3) can be charged (pressurized) using a gas (e.g., nitrogen) at a different pressure (e.g., a greater pressure) relative to atmospheric pressure. In such cases, a chamber 470 can be charged using an optional injection port 429 disposed in the wall 482 of the housing 485. For example, as shown in FIGS. 4A through 4C, optional injection port 429-1 is disposed in the wall 482 of the housing 485 adjacent to chamber 470-1, and optional injection port 429-2 is disposed at a different point in the wall 482 of the housing 485 adjacent to chamber 470-3. As a result, the one or more chambers 470 that are charged (e.g., pressurized to 5000 psi) can lessen the differential pressure between the pressure in the chambers 470 and the hydrostatic pressure caused by the fluid 478 as a result of the debris 479 that has accumulated in the cavity 413. This higher pressure in one or more of the chambers 470 allows the assembly 499 to be placed at greater depths within the wellbore 120 to bypass and/or clear the debris 479. When the pressure in the cavity 413 is high enough, the fluid 478 actuates the actuation device 480 in an effort to equalize the pressure in the chamber 470-1.

In other alternative embodiments, a vacuum can be created in one or more of the chambers 470 using one or more of the injection ports 429. In still other alternative embodiments, one or more of the chambers 470 can have one or more optional cartridges 431 disposed therein, where each optional cartridge 431 is configured to release a gas (e.g., nitrogen) when a triggering event (e.g., a change in pressure in the chamber 470, receipt of an electrical signal, slight movement of the piston 490, the passage of time) occurs. When the gas is released from the cartridge 431 travels into the cavity 413. When this occurs below or within the congestion in the cavity 413, then the pressure introduced into the cavity 413 from the gas can be greater than the hydrostatic pressure. As a result, the gas in the cavity 413 may loosen some or all of the debris 479. When cartridges 431 are used in a chamber 470, the injection port 429 associated with that chamber 470 can be omitted. In this example, an optional cartridge 431 is shown in chamber 470-3 attached to the distal end 493 of the piston 490. In alternative embodiments, a cartridge 431 can additionally or alternatively be placed in chamber 470-1 and/or chamber 470-2.

As defined herein, a chamber (e.g., chamber 470-1) is pressurized when any action is taken to manipulate the pressure within that chamber while the chamber is still intact (e.g., before an actuation device (e.g., actuation device 480) is actuated). Examples of how a chamber can be pressurized can include, but are not limited to, creating a vacuum in the chamber through an injection port (e.g., injection port 429-1), charging the chamber through an injection port (e.g., injection port 429-2), and activating a cartridge (e.g., cartridge 431) within the chamber. When multiple chambers of an obstruction relief tool (e.g., obstruction relief tool 450) are pressurized, once chamber can be pressurized in the same manner or in a different manner and/or at the same pressure or at a different pressure compared to the manner and pressure that one or more of the other chambers are pressurized.

When a chamber (e.g., chamber 470-2) of an obstruction relief tool (e.g., obstruction relief tool 450) discussed herein is pressurized, the pressurization can provide one or more of a number of benefits. For example, when a chamber of an obstruction relief tool is pressurized at a pressure (e.g., 5000 psi) that is higher than atmospheric pressure, the subassembly (e.g., subassembly 499) can be inserted into a wellbore 120 at greater depths to clear or bypass an obstruction (e.g., caused by debris 479) that is further downhole than what can be reached when the chambers are pressurized at atmospheric pressure. As another example, when a chamber is pressurized with gas (e.g., nitrogen), and when a pathway (e.g., channel 465) between the chamber and the cavity (e.g., cavity 413) is opened, the gas can be forced through the pathway to the cavity. When the pathway is where the debris (e.g., debris 479) is located in the cavity or is below where the debris is located in the cavity, the gas will rise within the cavity toward the surface 102. As a result, the gas may be able to loosen the debris enough to clear or lessen the congestion caused by the debris.

The outer wall 451 of the mandrel 454 can include one or more apertures 487 that traverse therethrough. These one or more apertures 487 (also sometimes called flow ports 487, pathways 487, or channels 487 herein) are located adjacent to chamber 470-1. Each aperture 487 can have any of a number of characteristics (e.g., width, cross-sectional shape, tapering). If there are multiple apertures 487, the characteristics of one aperture 487 can be the same as, or different than, the corresponding characteristics of one or more of the other apertures 487.

As shown in FIG. 4A, each aperture 487 is covered by or filled with an actuation device 480 when the obstruction relief tool 450 is in a deactivated state. Each actuation device 480 can be any type of device that becomes removable (e.g., breaks apart, slides away, opens) in some way so that the aperture 487 goes from being covered or filled in to being open when the actuation device 480 actuates. When the actuation device 480 actuates, starting the actuation process for the obstruction relief tool 450, the change in state of the actuation device 480 can be permanent or temporary.

An example of an actuation device 480 is a rupture disc. Another example of an actuation device 480 is a communication port. Yet another example of an actuation device 480 is a knock-off plug. The actuation device 480 can change state based on a physical change (e.g., a change in pressure within the cavity 413, a difference in pressure between the cavity 413 and chamber 470-1) and/or a command (e.g., an electrical signal sent by a controller, such as controller 804 of FIG. 8 below). In this case, the one or more apertures 487 (as shown in FIG. 4C), as well as the corresponding actuation devices 480 (as shown in FIG. 4A) are located toward the proximal end of the obstruction relief tool 450, above where the piston 490 and most, if not all, of the debris 479 are located.

The wall 451 of the mandrel 454 can also include the one or more channels 465 that traverse therethrough. These channels 465 are adjacent to the distal end 493 of the piston 490 when the piston 490 is in its natural or default position, as shown in FIGS. 4A and 4B. Each channel 465 can have any of a number of characteristics (e.g., width, cross-sectional shape, tapering). If there are multiple channels 465, the characteristics of one channel 465 can be the same as, or different than, the corresponding characteristics of one or more of the other channels 465.

The wall 451 of the mandrel 454 can also include one or more stops 460 (also called distal stops 460 or piston limiting devices 460). In this case there are two stops 460. Stop 460-1 is located within chamber 470-2 formed by the piston 490. Stop 460-2 is located within chamber 470-3 toward the distal end of the obstruction relief tool 450. Each stop 460 can be embedded in, disposed on, and/or otherwise coupled to the outer surface of the wall 451 of the mandrel 454. Each stop 460 is designed to abut against a portion of the piston 490 when the obstruction relief tool 450 is in the actuated state. For example, as shown in FIG. 4C, stop 460-1 is abutted by the proximal wall 491 of the piston 490, and stop 460-2 is abutted by the distal wall 493 of the piston 490. In this way, the distance between the leading (proximal) edge of stop 460-1 and stop 460-2 is substantially the same as the distance between the distal edge of the proximal wall 491 and the distal edge of the distal wall 493 of the piston 490.

The assembly 499 can also include one or more proximal stops 455. In this case, there is one proximal stop 455 that is located within chamber 470-1 against the outer surface of the wall 451 of the mandrel 454 and against the proximal edge of the proximal wall 491 of the piston 490. In some cases, an outer surface of the proximal stop 455 can have one or more features disposed thereon. For example, toward the proximal end of the mandrel 454, adjacent to the proximal stop 455 when the obstruction relief tool 450 is in the actuated position and extending distally toward distal stop 460-1, the outer surface of the wall 451 can have multiple notches disposed therein to complement one or more notches disposed on the mating outer surface of the proximal stop 455. In such a case, the notches can be used as a one-way rachet when the proximal stop 455 is in the form of a body lock ring, thereby allowing the proximal stop 455 (and so also the piston 490) to move distally away from, but not return proximally toward, the natural position (shown in FIG. 4A) of the stop 455. As discussed below with respect to FIGS. 5A and 5B, a proximal stop (e.g., proximal stop 555) can have any of a number of configurations and can be positioned at any of a number of other locations on the obstruction relief tool 450.

In light of the above, the position of the proximal stop 455 can be adjustable, as in this case. In certain example embodiments, the proximal stop 455 only moves toward the distal end of the obstruction relief tool 450 without being able to return to or move toward the proximal end of the obstruction relief tool 450. The proximal stop 455 can be an independent component of the obstruction relief tool 450 that is not attached to any other component. Alternatively, the proximal stop 455 can be coupled to the proximal edge of the proximal wall 491 of the piston 490.

The proximal wall 491 and the distal wall 493 of the piston 490 can each have one or more sealing members 464 (e.g., O-rings, gaskets) to maintain a seal against the wall 451 of the mandrel 454 as the piston 490 moves along the mandrel 454. In this example, the height of the proximal wall 491 is greater than the height of the distal wall 493. Specifically, in addition to abutting against the wall 451 of the mandrel 454, the proximal wall 491 of the piston 490 also abuts against the inner surface of the wall 482 of the housing 485. The proximal wall 491 can have one or more additional sealing members 464 to maintain a seal against the wall 482 of the housing 485.

The top wall 492 of the piston 490 can be oriented substantially parallel to the wall 451 of the mandrel 454 and the wall 482 of the housing 485, as shown in FIGS. 4A through 4C. In alternative embodiments, the wall 492 of the piston 490 can be antiparallel with the wall 451 of the mandrel 454 and/or the wall 482 of the housing 485. Since the top wall 492 in this case is parallel to the wall 451 of the mandrel 454 and the wall 482 of the housing 485, and since the height of the proximal wall 491 of the piston 490 is greater than the height of the distal wall 493 of the piston 490, the top wall 492 extends from the top of the distal wall 493 and ties into a side of the proximal wall 491. Because of this configuration, part of cavity 470-3 is disposed between the top wall 492 of the piston 490 and the wall 482 of the housing 485. The distance between the top wall 492 of the piston 490 and the wall 482 of the housing 485 can be large enough to allow for the flow of the debris 479, including chunks and large pieces, to flow therebetween to the larger portion of chamber 470-3 at the distal end of the housing 485.

In certain example embodiments, the top wall 492 of the piston 490 has one or more flow ports 495 (also called apertures 495, pathways 495, or channels 495 herein) that traverse therethrough. In this case, there are two apertures 495 (aperture 495-1 and aperture 495-2) that traverse the top wall 492. In some cases, as in this example, the flow ports 495-1 and 495-2 are always open so that the chamber 470-2 and the chamber 470-3 form a single chamber. In alternative embodiments, one or more of these flow ports 495 can have an actuation device (similar to actuation device 480) disposed therein. In such a case, those actuation devices can open/break away to reveal the flow port(s) 495 when a certain condition is met, such as when a certain amount of the debris 479 flows into chamber 470-2 so that some of the debris 479 can flow into chamber 470-3.

In this case, the wall 482 of the housing 485 is solid (e.g., has no flow ports) along its length. In alternative embodiments, the wall 482 of the housing 485 can have one or more flow ports that traverse therethrough. In such cases, one or more of those flow ports in the wall 482 can have an actuation device (similar to actuation device 480) disposed therein. In such a case, then the actuation devices can open/break away to reveal the flow port (or channel or aperture or pathway) when a certain condition is met, such as when a certain amount of the debris 479 flows into chamber 470-3 from chamber 470-2 through the flow ports 495. If flow ports are in the wall 482 of the housing 485, with or without actuation devices, debris 479 can flow from chamber 470-3 through those flow ports into the annulus 423 that is formed between the casing string 424 and the obstruction relief tool 450. Alternatively, there can be no actuation devices in the flow ports that traverse the wall 482 of the housing 485.

When the actuation device 480 actuates, some of the fluid 478 in the cavity 413 flows through the resulting aperture 487 and into the chamber 470-1. As shown in FIG. 4C, when enough fluid 478 flows into the chamber 470-1, the fluid 478 forces the piston 490 toward the distal end of the obstruction relief tool 450. As the piston 490 begins to move distally, the distal wall 493 of the piston 490 uncovers the channels 465, allowing some of the debris 479 to flow through the channels 465 into chamber 470-2. Once the piston 490 begins to move distally, the proximal stop 455, interacting with features in the outer surface of the wall 451 of the mandrel 454, prevents the piston 490 from reversing its path in the proximal direction.

As the piston 490 continues to move distally due to the inflow of more fluid 478 into chamber 470-1, more debris 479 flows through the channels 465, which are now open, into chamber 470-2. Eventually, some of this debris 479 overflows through the flow ports 495 in the top wall 492 of the piston 490 and into chamber 470-3. Eventually, as shown in FIG. 4C, the piston 490 is pinned against the distal stops 460 by proximal stop 455, even if the pressure applied distally to the piston 490 by the fluid 478 in chamber 470-1 is no longer able to overcome the countering pressure applied by the debris 479 in chamber 470-2 and chamber 470-3. When the debris 479 fills chamber 470-2 and chamber 470-3, there may be little enough debris 479 left in the cavity 413 that the fluid 478, mixing with and diluting the debris 479, re-establishes flow of the fluid 478 to and through the tool 407.

In some cases, chamber 470-1 and chamber 470-3 can be considered portions of a single chamber 470 that are physically separated from each other when the piston 490 is in its default position and that are continuous when the piston 490 is moved to its distal position. Similarly, if there are no actuation devices in flow port 495-1 and flow port 495-2, then chamber 470-2 and chamber 470-3 can be considered portions of a single chamber 470 that are continuous through the flow ports 495. If flow port 495-1 and flow port 495-2 are normally closed with actuation devices, then chamber 470-2 and chamber 470-3 can be considered portions of a single chamber 470 that are physically separated from each other when the actuation devices are not actuated and that are continuous when the actuation devices are actuated.

Figure 5A:
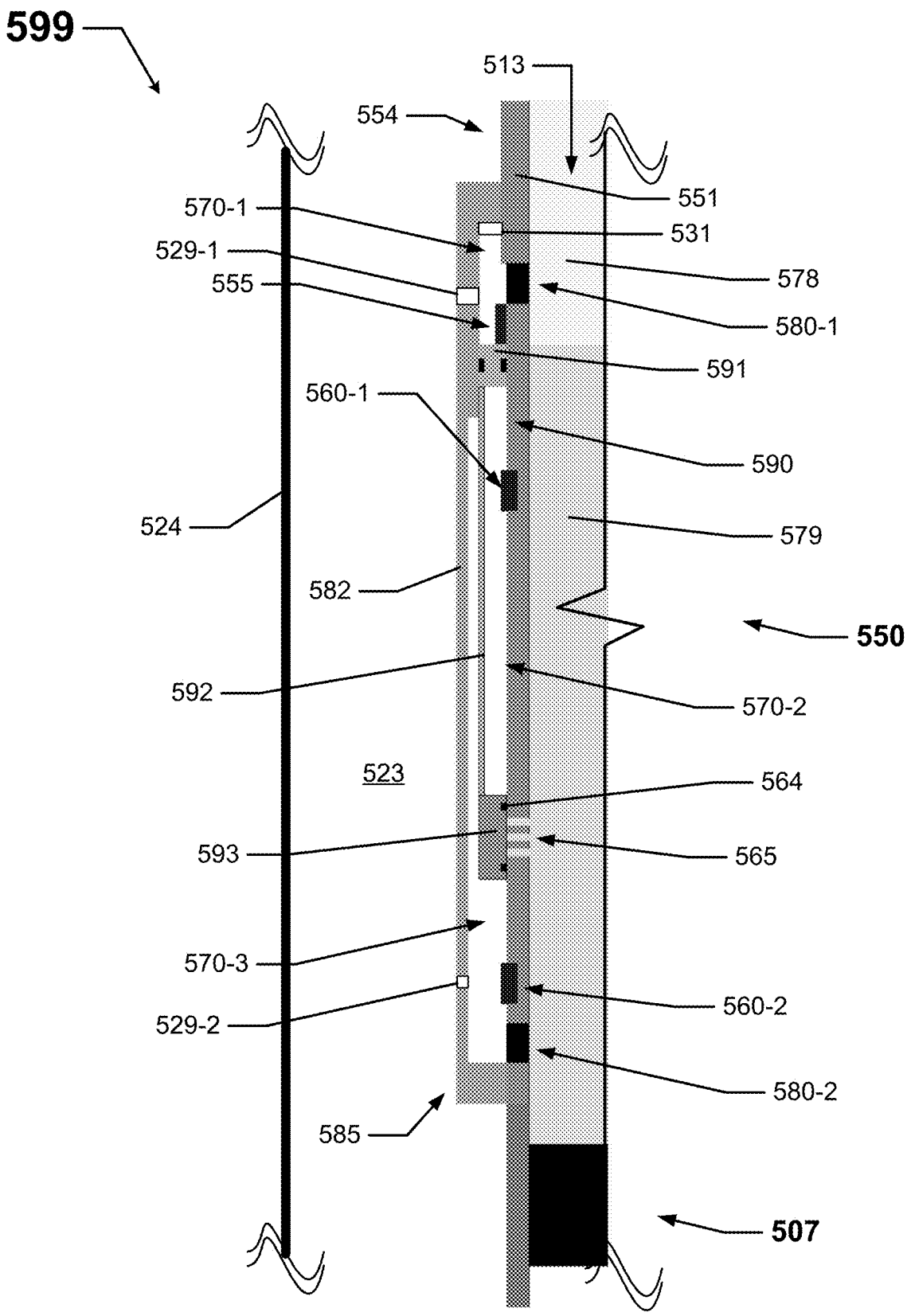
FIGS. 5A and 5B show various views of another assembly in accordance with certain example embodiments.
Figure 5B:
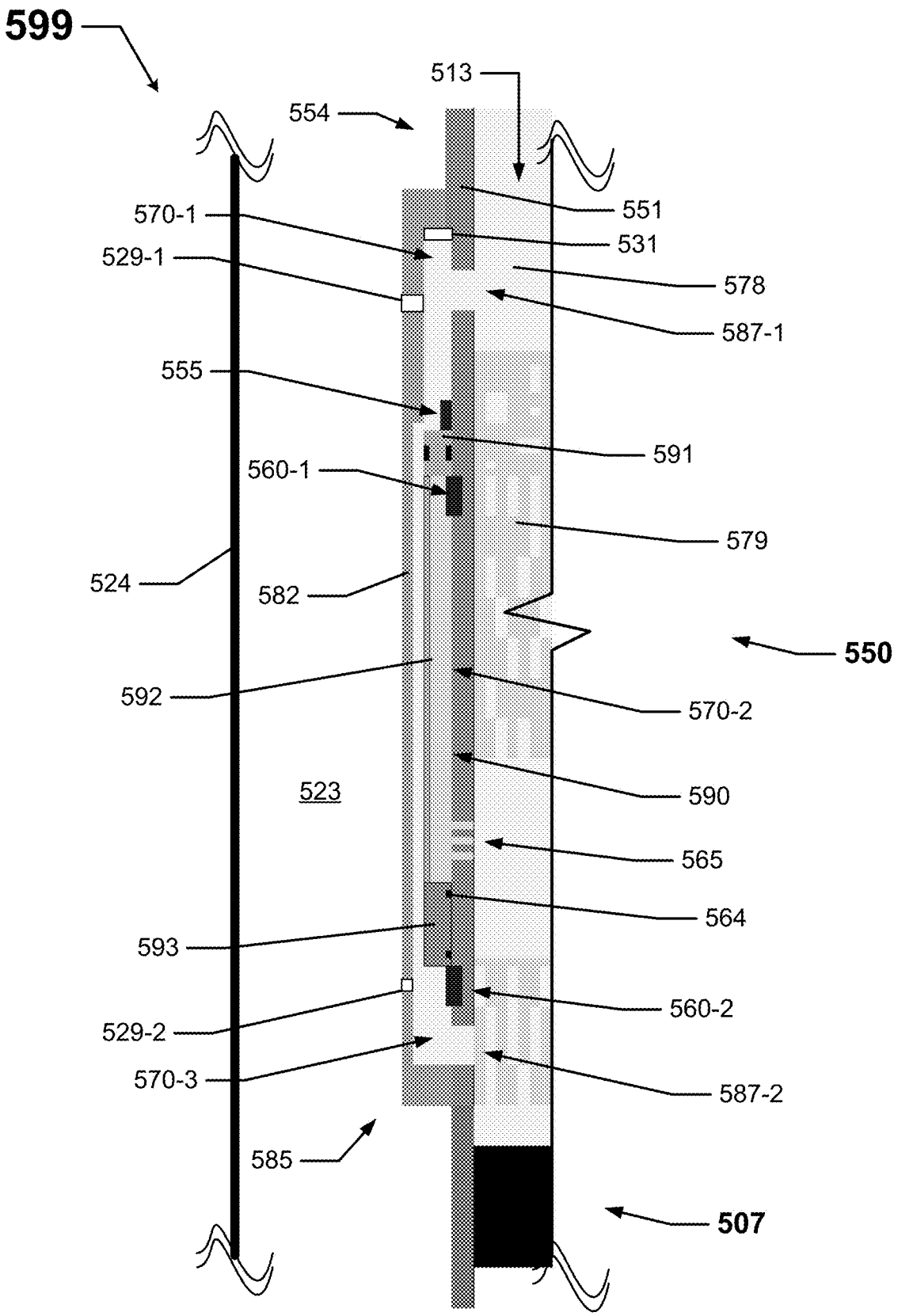

FIGS. 5A and 5B show cross-sectional side views of another assembly 599 in accordance with certain example embodiments. Specifically, FIG. 5A shows a partial cross-sectional view of the assembly 599 that includes an obstruction relief tool 550 in a disengaged state. FIG. 5B shows a partial cross-sectional side view of the assembly 599 with the obstruction relief tool 550 in an engaged state. Referring to FIGS. 1 through 5B, the assembly 599 in this case includes a tool 507 and the example obstruction relief tool 550 that are coupled (e.g., threadably) to each other in series. As stated above with respect to FIG. 1, the obstruction relief tool 550 can be coupled (e.g., threadably) to a tubing pipe 115 of the tubing string 114.

When placed in a wellbore 120, the obstruction relief tool 550 is located closer to the surface 102 than (upstream of) the tool 507 (e.g., a FLV). The tool 507 of FIGS. 5A and 5B is substantially the same as the tools discussed above with respect to FIGS. 1 through 4C. The various components (e.g., housing 585, piston 590, chamber 570-3) of the obstruction relief tool 550 can be disposed around some or all of the outer perimeter of the wall 551 of the mandrel 554. In some cases, there can be multiple instances of one or more of these components distributed (e.g., equidistantly, randomly) around the outer perimeter of the mandrel 554. When there are multiples of a component, one of them can be configured the same as, or differently than, at least one of the others.

As discussed above, there are many ways in which an example obstruction relief tool 550 can relieve the obstruction caused by the debris 579. In this case, as with the embodiment of the obstruction relief tool 450 of FIGS. 4A through 4C, the obstruction relief tool 550 collects some of the debris 579 from the cavity 513, thereby dissipating the debris 579 so that more of the fluid 578 can mix with the debris 579 in the cavity 513 and, in some cases, relieve the obstruction. In addition, the obstruction relief tool 550 of FIGS. 5A and 5B creates a bypass for the fluid 578 around the debris 579. The example obstruction relief tool 550 can have any of a number of configurations for removing some or all of the debris 579 to allow the fluid 578 to reach the tool 507. For example, the obstruction relief tool 550 of the assembly 599 of FIGS. 5A and 5B can include a base cylinder 554 (e.g., a mandrel 554) formed by a wall 551, a housing 585 that extends outward from some or all of the wall 551 of the mandrel 554, and a piston 590 that is movably disposed within the housing 585.

The housing 585 has one or more housing walls 582 that abut against the wall 551 of the mandrel 554 to form at least one pressurized chamber 570. Specifically, in this case, there are three separate chambers 570 within the housing 585. Chamber 570-1 is disposed at the proximal end (furthest away from the tool 507) of the housing 585, partially bounded by the piston 590. Chamber 570-2 is disposed within the piston 590, which is partially bounded by the wall 551 of the mandrel 554. Chamber 570-3 is partially disposed at the distal end (closest to the tool 507) of the housing 585, between the outer wall 582 of the housing 585 and the outer wall 592 and the distal wall 593 of the piston 590.

In certain example embodiments, each of these chambers 570 is pressurized at atmospheric pressure (approximately 14.7 psi). As a result, the chambers 570 are at a relatively low pressure compared to the relatively high hydrostatic pressure caused by the fluid 578 as a result of the debris 579 that has accumulated in the cavity 513. Consequently, when the pressure in the cavity 513 is high enough, the fluid 578 actuates the actuation device 580-1 in an effort to equalize the pressure in the chamber 570-1.

In alternative embodiments, one or more of the chambers 570 (e.g., chamber 570-1) can be charged (pressurized) using a gas (e.g., nitrogen) at a different pressure (e.g., a greater pressure) relative to atmospheric pressure. In such cases, a chamber 570 can be charged using an optional injection port 529 disposed in the wall 582 of the housing 585. For example, as shown in FIGS. 5A and 5B, optional injection port 529-1 is disposed in the wall 582 of the housing 585 adjacent to chamber 570-1, and optional injection port 529-2 is disposed at a different point in the wall 582 of the housing 585 adjacent to chamber 570-3. As a result, the one or more chambers 570 that are charged (e.g., pressurized to 5000 psi) can lessen the differential pressure between the pressure in the chambers 570 and the hydrostatic pressure caused by the fluid 578 as a result of the debris 579 that has accumulated in the cavity 513. This higher pressure in the chambers 570 allows the assembly 599 to be placed at greater depths within the wellbore 120 to bypass and/or clear the debris 579. When the pressure in the cavity 513 is high enough, the fluid 578 actuates the actuation device 580-1 in an effort to equalize the pressure in the chamber 570-1.

In other alternative embodiments, a vacuum can be created in one or more of the chambers 570 using one or more of the injection ports 529. In still other alternative embodiments, one or more of the chambers 570 can have one or more optional cartridges 531 disposed therein, where each optional cartridge 531 is configured to release a gas (e.g., nitrogen) when a triggering event (e.g., a change in pressure in the chamber 570, receipt of an electrical signal, slight movement of the piston 590, the passage of time) occurs. When the gas is released from the cartridge 531, the gas travels into the cavity 513. When this occurs below or within the congestion in the cavity 513, then the pressure introduced into the cavity 513 from the gas can be greater than the hydrostatic pressure. As a result, the gas in the cavity 513 may loosen some or all of the debris 579. When one or more cartridges 531 are used in a chamber 570, the injection port 529 associated with that chamber 570 can be omitted. In this example, an optional cartridge 531 is shown in chamber 570-1. In alternative embodiments, a cartridge 531 can additionally or alternatively be placed in chamber 570-2 and/or chamber 570-3.

The outer wall 551 of the mandrel 554 can include one or more apertures 587 that traverse therethrough. In this case there are two apertures 587 (or sets of apertures 587), which can also be called flow ports 587, pathways 587, or channels 587 herein. Apertures 587-1 are located adjacent to chamber 570-1, and apertures 587-2 are located adjacent to chamber 570-3. Each aperture 587 can have any of a number of characteristics (e.g., width, cross-sectional shape, tapering). If there are multiple apertures 587, the characteristics of one aperture 587 can be the same as, or different than, the corresponding characteristics of one or more of the other apertures 587.

As shown in FIG. 5A, each aperture 587 is covered by or filled with an actuation device 580 when the obstruction relief tool 550 is in a deactivated state. Specifically, actuation device 580-1 covers/fills apertures 587-1, and actuation device 580-2 covers/fills apertures 587-2. Each actuation device 580 can be any type of device that becomes removable (e.g., breaks apart, slides away, opens) in some way so that the corresponding aperture 587 goes from being covered or filled in to being open when the actuation device 580 actuates. When an actuation device 580 actuates, starting the actuation process for the obstruction relief tool 550, the change in state of the actuation device 580 can be permanent or temporary. An example of an actuation device 580 is a rupture disc. Another example of an actuation device 580 is a communication port. Yet another example of an actuation device 580 is a knock-off plug.

An actuation device 580 can change state based on a physical change (e.g., a change in pressure within the cavity 513, a difference in pressure between the cavity 513 and chamber 570-1) and/or a command (e.g., an electrical signal sent by a controller, such as controller 804 of FIG. 8 below). In this case, the one or more apertures 587-1 (as shown in FIG. 5B), as well as the one or more corresponding actuation devices 580-1 (as shown in FIG. 5A) are located toward the proximal end of the obstruction relief tool 550, ahead of where the piston 590 is located. In addition, one or more apertures 587-2 (as shown in FIG. 5B), as well as the one or more corresponding actuation devices 580-2 (as shown in FIG. 5A) are located toward the distal end of the obstruction relief tool 550, beyond where the piston 590 is located.

The wall 551 of the mandrel 554 can also include one or more channels 565 that traverse therethrough. These channels 565 (also sometimes called flow ports 565, pathways 565, or apertures 565 herein) are adjacent to the distal end 593 of the piston 590 when the piston 590 is in its natural or default position, as shown in FIG. 5A. Each channel 565 can have any of a number of characteristics (e.g., width, cross-sectional shape, tapering). If there are multiple channels 565, the characteristics of one channel 565 can be the same as, or different than, the corresponding characteristics of one or more of the other channels 565.

The wall 551 of the mandrel 554 can also include one or more stops 560 (also called distal stops 560 or piston limiting devices 560). In this case there are two stops 560. Stop 560-1 is located within chamber 570-2 formed by the piston 590. Stop 560-2 is located within chamber 570-3 toward the distal end of the obstruction relief tool 550. Each stop 560 can be embedded in, disposed on, and/or otherwise coupled to the outer surface of the wall 551 of the mandrel 554. Each stop 560 is designed to abut against a portion of the piston 590 when the obstruction relief tool 550 is in the actuated state. For example, as shown in FIG. 5B, stop 560-1 is abutted by the proximal wall 591 of the piston 590, and stop 560-2 is abutted by the distal wall 593 of the piston 590. In this way, the distance between the leading (proximal)

edges of stop 560-1 and stop 560-2 is substantially the same as the distance between the distal edge of the proximal wall 591 of the piston 590 and the distal edge of the distal wall 593 of the piston 590.

The assembly 599 can also include one or more proximal stops 555. In this case, there is one proximal stop 555 that is located within chamber 570-1 against the outer surface of the wall 551 of the mandrel 554 and against the proximal edge of the proximal wall 591 of the piston 590. In some cases, an outer surface of the proximal stop 555 can have one or more features disposed thereon. For example, toward the proximal end of the mandrel 554, adjacent to the proximal stop 555 when the obstruction relief tool 550 is in the actuated position and extending distally toward the distal stop 560-1, the outer surface of the wall 551 can have multiple notches disposed therein to complement one or more notches disposed on the mating outer surface of the proximal stop 555. In such a case, the notches can be used as a one-way rachet when the proximal stop 555 is in the form of a body lock ring, thereby allowing the proximal stop 555 (and so also the piston 590) to move distally away from, but not return proximally toward, the natural position of the stop 555 (shown in FIG. 5A).

The proximal stop 555 can also have other configurations, such as a snap ring that pops into a groove on the outer surface of the wall 551. In some cases, the obstruction relief tool 550 can include multiple stops. In addition, or in the alternative, a stop, such as proximal stop 555, can be placed at other locations on the obstruction relief tool 550. For example, a stop can be placed on the outer wall 592 of the piston 590 and engage one or more features on the inner surface of the wall 582 of the housing 585. As another example, a stop can be placed on the distal wall 593 of the piston 590 and engage one or more features on the outer surface of the wall 551 of the mandrel 554.

In light of the above, the position of the proximal stop 555 can be adjustable, as in this case. In certain example embodiments, the proximal stop 555 only moves toward the distal end of the obstruction relief tool 550 without being able to return to or move toward the proximal end of the obstruction relief tool 550. The proximal stop 555 can be an independent component of the obstruction relief tool 550 that is not attached to any other component. Alternatively, the proximal stop 555 can be coupled to the proximal edge of the proximal wall 591 of the piston 590.

The proximal wall 591 and the distal wall 593 of the piston 590 can each have one or more sealing members 564 (e.g., O-rings, gaskets) to maintain a seal against the wall 551 of the mandrel 554 as the piston 590 moves along the mandrel 554. In this example, the height of the proximal wall 591 is substantially the same as the height of the distal wall 593. In addition to abutting against the wall 551 of the mandrel 554, the proximal wall 591 of the piston 590 also abuts against the inner surface of the wall 582 of the housing 585, but only when the obstruction relief tool 550 is in an unactuated state. As the obstruction relief tool 550 converts to an actuated state, because of the non-uniform thickness of the wall 582 of the housing 585, the proximal wall 591 loses contact with the wall 582 as the piston 590 moves distally. The proximal wall 591 can have one or more additional sealing members 564 to maintain a seal against the wall 582 of the housing 585 while the two are in contact in the unactuated state.

The top wall 592 of the piston 590 can be oriented substantially parallel to the wall 551 of the mandrel 554 and the wall 582 (or at least the top surface thereof) of the housing 585, as shown in FIGS. 5A and 5B. In alternative embodiments, the top wall 592 of the piston 590 can be antiparallel with the wall 551 of the mandrel 554 and the wall 582 of the housing 585. Since the top wall 592 in this case is parallel to the wall 551 of the mandrel 554 and the wall 582 of the housing 585. The top wall 592 of the piston 590 extends from the top of the distal wall 593 and from the top of the proximal wall 591.

As discussed above, the wall 582 of the housing 585 has a non-uniform thickness. In this case, the wall 582 has a first thickness from its proximal end to a bit beyond the proximal wall 591 of the piston 590 when the piston 590 is in its default (non-actuated) state. After that point, the remainder of the wall 582 of the housing has another lesser thickness. The outer surface of the wall 582 is uniform along its length, so the difference in thickness is evidenced along the bottom surface of the wall 582. Because of this configuration, part of cavity 570-3 is disposed between the top wall 592 of the piston 590 and the less-thick portion of the wall 582 of the housing 585. The distance between the top wall 592 of the piston 590 and the less-thick portion of the wall 582 of the housing 585 can be large enough to allow for the flow of the debris 579, including chunks and large pieces, to flow therebetween to the larger portion of chamber 570-3 at the distal end of the housing 585.

While not shown in FIGS. 5A and 5B, in certain example embodiments, the top wall 592 of the piston 590 can have one or more apertures or flow ports (e.g., similar to flow ports 495 in FIGS. 4A through 4C) that traverse therethrough. In this case, unlike the embodiment shown in FIGS. 4A through 4C, there are no apertures that traverse the top wall 592 of the piston. As a result, chamber 570-2 remains isolated from chamber 570-1 and chamber 570-3 as the obstruction relief tool 550 becomes actuated. In this case, the wall 582 of the housing 585 is solid (e.g., has no flow ports) along its non-uniform length.

When the actuation device 580-1 actuates, some of the fluid 578 in the cavity 513 flows through the resulting aperture 587-1 and into the chamber 570-1. As shown in FIG. 5B, when enough fluid 578 flows into the chamber 570-1, the fluid 578 forces the piston 590 toward the distal end of the obstruction relief tool 550. As the piston 590 begins to move distally, the distal wall 593 of the piston 590 uncovers the channels 565, in some cases allowing some of the debris 579 to flow through the channels 565 into chamber 570-2. Once the piston 590 begins to move distally, the proximal stop 555, interacting with features in the outer surface of the wall 551 of the mandrel 554, prevents the piston 590 from reversing its path in the proximal direction.

As the piston 590 continues to move distally due to the inflow of more fluid 578 into chamber 570-1 from the cavity 513, more debris 579 can flow into chamber 570-2. Eventually, the piston 590 moves far enough distally that the proximal wall 591 of the piston 590 no longer makes direct contact with the inner surface of the wall 582 of the housing 585. At that point, the part of chamber 570-3 disposed between the top wall 592 of the piston 590 and the wall 582 of the housing 585 becomes continuous with chamber 570-1. As a result, the fluid 578 in chamber 570-1 begins to flow into chamber 570-3. As this fluid 578 builds at the distal end of chamber 570-3, the actuation device 580-2 disposed in aperture 587-2 actuates, allowing the fluid 578 in chamber 570-3 to flow through aperture 587-2 back into the cavity 513 just above the tool 507.

In this way, if the physical removal of debris 579 from the cavity 513 into chamber 570-2 is not sufficient to remove the obstruction in the cavity 513 caused by the debris 579, then the flow of fluid 578 from the cavity 513 through aperture 587-1, chamber 570-1, chamber 570-3, and aperture 587-2 back into the cavity 513 can bypass the obstruction. Whichever is successful, the obstruction relief tool 550 can remove and/or bypass the obstruction in the cavity 513 to re-establish flow of the fluid 578 to the tool 507. In some cases, chamber 570-1 and chamber 570-3 can be considered portions of a single chamber 570 that are physically separated from each other when the piston 590 is in its default position and that are continuous when the piston 590 is moved to its distal position.

Figure 6A:
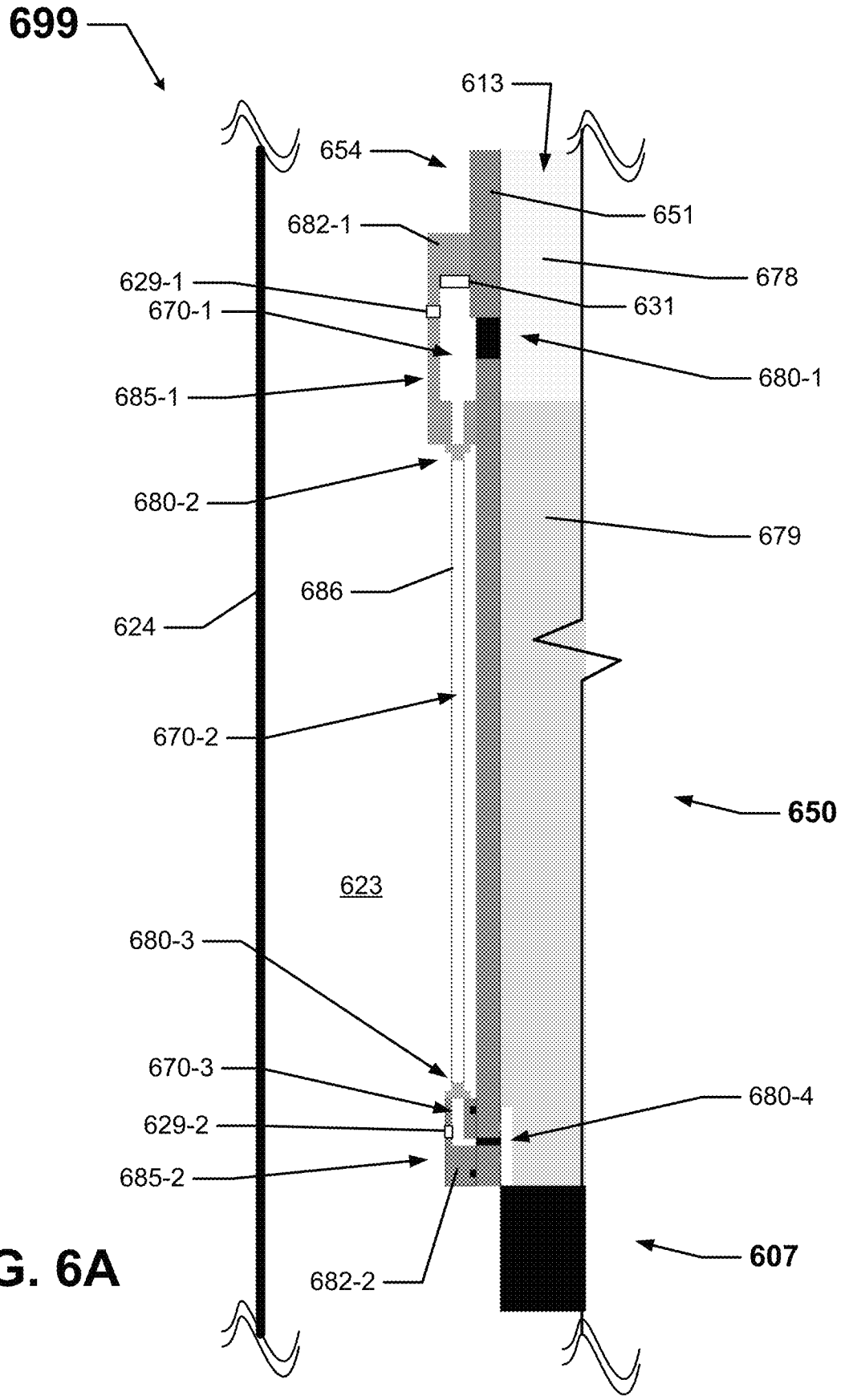
FIGS. 6A and 6B show various views of yet another assembly in accordance with certain example embodiments.
Figure 6B:
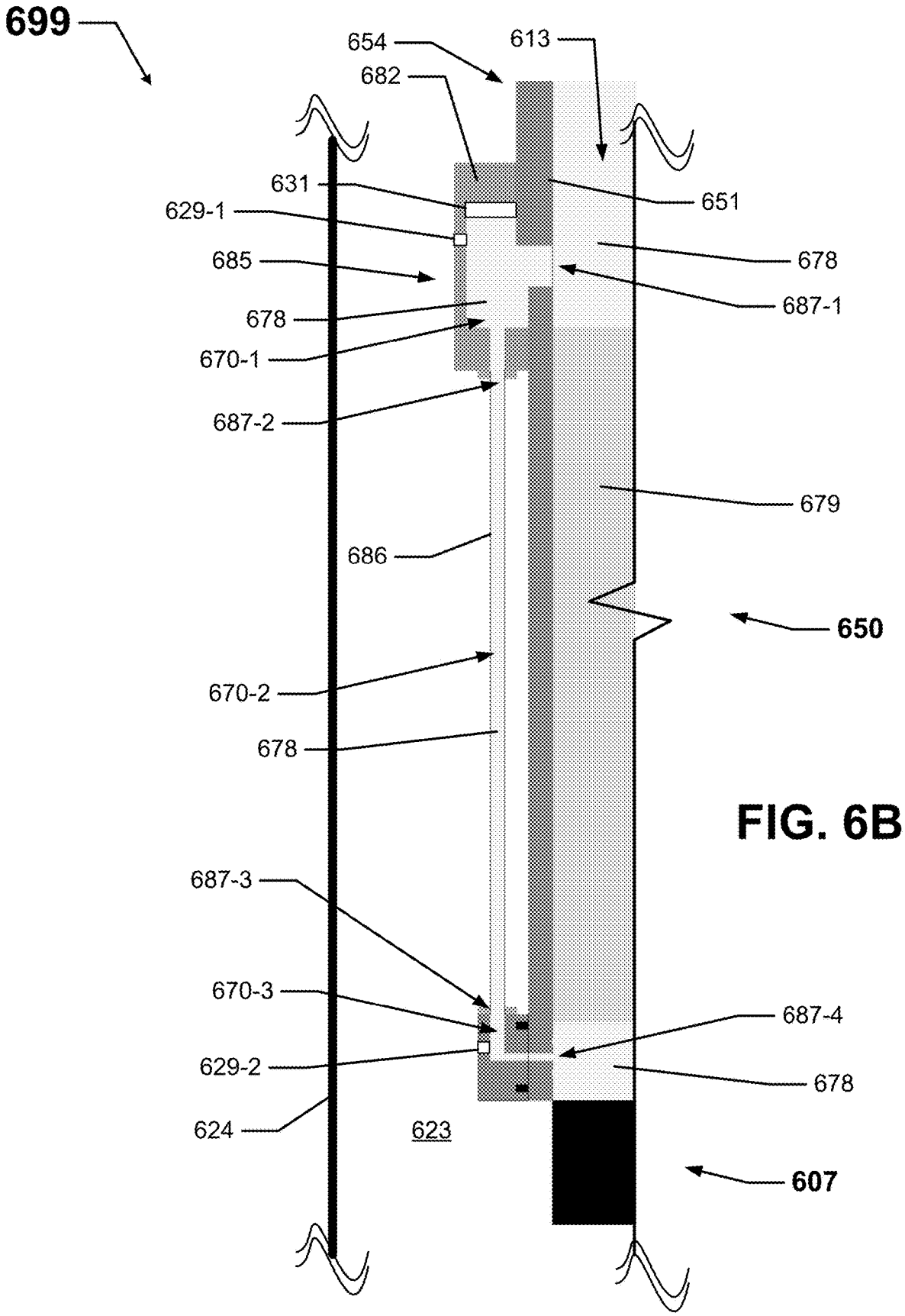

FIGS. 6A and 6B show various views of yet another assembly 699 in accordance with certain example embodiments. Specifically, FIG. 6A shows a cross-sectional side view of the assembly 699 with an obstruction relief tool 650 in a disengaged state. FIG. 6B shows a cross-sectional side view of the assembly 699 of FIG. 6A with the obstruction relief tool 650 in an engaged state. Referring to FIGS. 1 through 6B, the assembly 699 in this case includes a tool 607 and the example obstruction relief tool 650 that are coupled (e.g., threadably) to each other in series. As stated above with respect to FIG. 1, the obstruction relief tool 650 can be coupled (e.g., threadably) to a tubing pipe 115 of the tubing string 114.

When placed in a wellbore 120, the obstruction relief tool 650 is located closer to the surface 102 than (upstream of) the tool 607 (e.g., a FLV). The tool 607 of FIGS. 6A and 6B is substantially the same as the tools discussed above with respect to FIGS. 1 through 5B. The various components (e.g., housing 685-1, bypass line 686, chamber 670-2) of the obstruction relief tool 650 can be disposed around some or all of the outer perimeter of the wall 651 of the mandrel 654. In some cases, there can be multiple instances of one or more of these components distributed (e.g., equidistantly, randomly) around the outer perimeter of the mandrel 654. When there are multiples of a component, one of them can be configured the same as, or differently than, at least one of the others.

As shown in FIG. 6A, during a field operation (e.g., a completion operation) in a wellbore 120, a large amount of debris 679 has accumulated in the cavity 613 within the obstruction relief tool 650 and just above the tool 607. The build-up of debris 679 forms an obstruction in the cavity 613 that prevents fluid 678 (e.g., completion fluid) from reaching the tool 607, which can reduce or prevent the operational viability of the tool 607. The example obstruction relief tool 650 can remove some or all of the debris 679 from the cavity 613, thereby reducing or eliminating the obstruction, allowing the fluid 678 to reach the tool 607 at a proper (or at least more sufficient) flow rate to allow the tool 607 to operate properly and the field operation to proceed.

In this case, the obstruction relief tool 650 provides a bypass for the fluid 678 around the obstruction in the cavity 613 caused by the debris 679. The example obstruction relief tool 650 can have any of a number of configurations for providing a bypass for the fluid 678 around some or all of the debris 679, thereby allowing the fluid 678 to reach the tool 607. For example, the obstruction relief tool 650 of the assembly 699 of FIGS. 6A and 6B can include a base cylinder 654 (e.g., a mandrel 654) formed by a wall 651, a housing 685-1 that extends along a portion of the length of the wall 651 at the proximal end of the mandrel 654, another housing 685-2 that extends along a portion of the length of the wall 651 at the distal end of the mandrel 654, and a bypass line 686 disposed between the housings 685-1 and 685-2.

The housing 685-1 has one or more housing walls 682-1 that abuts against the wall 651 of the mandrel 654 to form at least one chamber 670-1. Similarly, the housing 685-1 has one or more housing walls 682-2 that abuts against the wall 651 of the mandrel 654 to form at least one chamber 670-3. In this case, there is a single chamber 670-1 within the housing 685-1. Chamber 670-1 is disposed within the housing 685-1 at the proximal end (furthest away from the tool 607) of the mandrel 654. Chamber 670-3 is disposed within the housing 685-2 at the distal end (closest to the tool 607) of the mandrel 654. Chamber 670-2 is disposed within the bypass line 686.

In certain example embodiments, each of these chambers 670 is pressurized at atmospheric pressure. As a result, the chambers 670 are at a relatively low pressure compared to the relatively high hydrostatic pressure caused by the fluid 678 as a result of the debris 679 that has accumulated in the cavity 613. Consequently, when the pressure in the cavity 613 is high enough, the fluid 678 actuates the actuation device 680-1 in an effort to equalize the pressure in the chamber 670-1.

In alternative embodiments, one or more of the chambers 670 (e.g., chamber 670-1) can be charged (pressurized) using a gas (e.g., nitrogen) at a different pressure (e.g., a greater pressure) relative to atmospheric pressure. In such cases, a chamber 670 can be charged using an optional injection port 629 disposed in a wall 682 of a housing 685. For example, as shown in FIGS. 6A and 6B, optional injection port 629-1 is disposed in the wall 682-1 of the housing 685-1 adjacent to chamber 670-1, and optional injection port 629-2 is disposed in the wall 682-2 of the housing 685-2 adjacent to chamber 670-3. As a result, the one or more chambers 670 (e.g., chamber 670-1, chamber 670-3) that are charged (e.g., pressurized to 5000 psi) can lessen the differential pressure between the pressure in the chambers 670 and the hydrostatic pressure caused by the fluid 678 as a result of the debris 679 that has accumulated in the cavity 613. This higher pressure in the chambers 670 allows the assembly 699 to be placed at greater depths within the wellbore 120 to bypass and/or clear the debris 679. When the pressure in the cavity 613 is high enough, the fluid 678 actuates an actuation device (e.g., actuation device 680-1, actuation device 680-4) in an effort to equalize the pressure in the associated chamber (e.g., chamber 670-1, chamber 670-3).

In other alternative embodiments, a vacuum can be created in one or more of the chambers 670 using one or more of the injection ports 629. In still other alternative embodiments, one or more of the chambers 670 can have one or more optional cartridges 631 disposed therein, where each optional cartridge 631 is configured to release a gas (e.g., nitrogen) when a triggering event (e.g., a change in pressure in the chamber 670, receipt of an electrical signal, the passage of time) occurs. When the gas is released from the cartridge 631, the gas travels into the cavity 613. When this occurs below or within the congestion in the cavity 613, then the pressure introduced into the cavity 613 from the gas can be greater than the hydrostatic pressure. As a result, the gas in the cavity 613 may loosen some or all of the debris 679. When one or more cartridges 631 are used in a chamber 670, the injection port 629 associated with that chamber 670 can be omitted. In this example, an optional cartridge 631 is shown in chamber 670-1. In alternative embodiments, a cartridge 631 can additionally or alternatively be placed in chamber 670-2 and/or chamber 670-3.

The outer wall 651 of the mandrel 654 can include one or more apertures 687 that traverse therethrough. Similarly, other parts of the obstruction relief tool 650 can have one or more apertures 687 along the flow path therethrough. In this case, there are four apertures 687 (also sometimes called flow ports 687, pathways 687, or channels 687 herein) in the obstruction relief tool 650. As shown in FIG. 6B, aperture 687-1 is located between chamber 670-1 and the cavity 613, aperture 687-2 is located between chamber 670-1 and chamber 670-2, aperture 687-3 is located between chamber 670-2 and chamber 670-3, and aperture 687-4 is located between chamber 670-3 and the cavity 613. Each aperture 687 can have any of a number of characteristics (e.g., width, cross-sectional shape, tapering). If there are multiple apertures 687, the characteristics of one aperture 687 can be the same as, or different than, the corresponding characteristics of one or more of the other apertures 687.

As shown in FIG. 6A, each aperture 687 is covered by or filled with an actuation device 680 when the obstruction relief tool 650 is in a deactivated state. Specifically, actuation device 680-1 covers/fills aperture 687-1, actuation device 680-2 covers/fills aperture 687-2, actuation device 680-3 covers/fills aperture 687-3, and actuation device 680-4 covers/fills aperture 687-4. Each actuation device 680 can be any type of device that becomes removable (e.g., breaks apart, slides away, opens) in some way so that the corresponding aperture 687 goes from being covered or filled in to being open when the actuation device 680 actuates.

When an actuation device 680 actuates, the change in state can be permanent or temporary. An example of an actuation device 680 is a rupture disc. Another example of an actuation device 680 is a communication port. Yet another example of an actuation device 680 is a knock-off plug. An actuation device 680 can change state based on a physical change (e.g., a change in pressure within the cavity 613, a difference in pressure between the cavity 613 and chamber 670-1) and/or a command (e.g., an electrical signal sent by a controller, such as controller 804 of FIG. 8 below).

When the actuation device 680-1 actuates, starting the actuation process for the obstruction relief tool 650, some of the fluid 678 in the cavity 613 above the debris 679 (at the proximal end of the obstruction relief tool 650) flows through the resulting aperture 687-1 and into the chamber 670-1. As shown in FIG. 6B, when enough fluid 678 flows into the chamber 670-1, the fluid 678 forces actuation device 680-2, located at the junction between chamber 670-1 and chamber 670-2, to actuate. When this occurs, the corresponding aperture 687-2 opens, allowing the fluid 678 to flow from chamber 670-1 to chamber 670-2. Subsequently, as the fluid 678 flows along chamber 670-2 (the bypass line), the fluid 687 can force actuation device 680-3, located at the junction between chamber 670-2 and chamber 670-3, to actuate. When this occurs, the corresponding aperture 687-3 opens, allowing the fluid 678 to flow from chamber 670-2 to chamber 670-3. Subsequently, as the fluid 678 fills chamber 670-3, the fluid 687 can force actuation device 680-4, located at the junction between chamber 670-3 and cavity 613, to actuate. When this occurs, the corresponding aperture 687-4 opens, allowing the fluid 678 to flow from chamber 670-3 to the cavity 613. In this way, obstruction relief tool 650 bypasses the fluid 678 around the obstruction caused by the debris 679 in the cavity 613, which re-establishes flow of the fluid 678 to the tool 607.

In alternative embodiments, the obstruction relief tool 650 has only one actuation device 680 (e.g., actuation device 680-4). As a result, the other actuation devices 680 shown in FIGS. 6A and 6B (e.g., actuation devices 680-1, 680-2, and 680-3) can be optional. In such a case, one or more additional components (e.g., a filter) can be used to replace an actuation device 680. When one or more filters are used, the filtered ("cleaned") fluid 678 can circulate through the obstruction relief tool 650 when it is run in hole.

In some cases, chamber 670-1, chamber 670-2, and chamber 670-3 can be considered portions of a single chamber 670 that are physically separated from each other when the actuation device 680-2 and actuation device 680-3 are in their default conditions. When actuation device 680-2 and actuation device 680-3 are actuated, chamber 670-1, chamber 670-2, and chamber 670-3 can be considered portions of a single continuous chamber 670.

Figure 7:
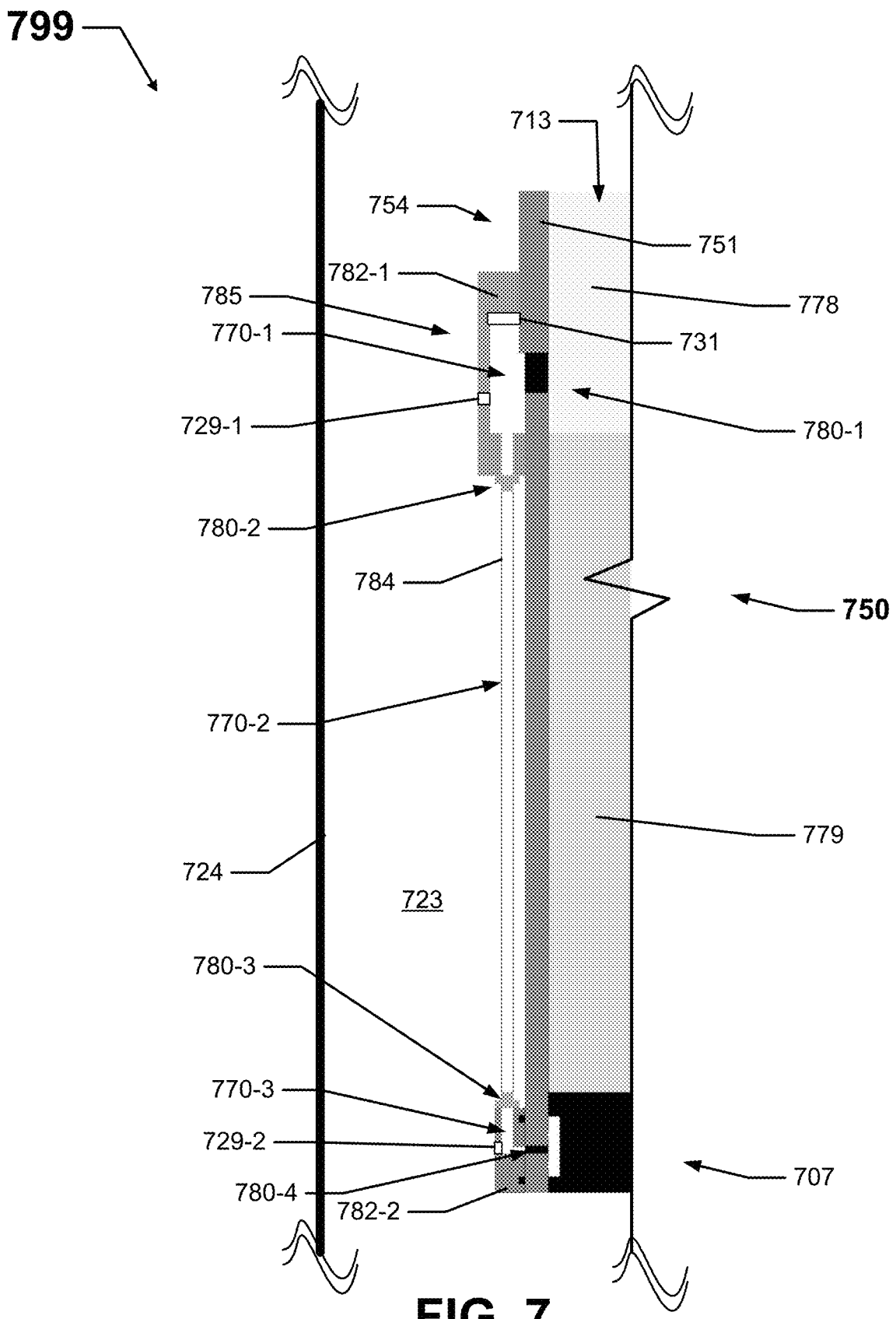
FIG. 7 shows still another assembly in accordance with certain example embodiments.

FIG. 7 shows a cross-sectional side view of still another assembly 799 in accordance with certain example embodiments. The assembly 799 of FIG. 7 (shown in the unactuated state) is substantially the same as the assembly 699 of FIGS. 6A and 6B, except that with the assembly 799 of FIG. 7, the tool 707 is integrated with the obstruction relief tool 750 as an integrated unit. Referring to FIGS. 1 through 7, the tool 707 of FIG. 7 is substantially the same as the tools discussed above with respect to FIGS. 1 through 6B, except that in this case, the tool 707 is integrated with the obstruction relief tool 750 rather than being a separate component that is mechanically coupled to a distal end of the obstruction relief tool 750.

As stated above with respect to FIG. 1, the obstruction relief tool 750 can be coupled (e.g., threadably) to a tubing pipe 115 of the tubing string 114. The various components (e.g., housing 785-1, bypass line 786, chamber 770-2) of the obstruction relief tool 750 can be disposed around some or all of the outer perimeter of the wall 751 of the mandrel 754. In some cases, there can be multiple instances of one or more of these components distributed (e.g., equidistantly, randomly) around the outer perimeter of the mandrel 754. When there are multiples of a component, one of them can be configured the same as, or differently than, at least one of the others.

As shown in FIG. 7, during a field operation (e.g., a completion operation) in a wellbore 120, a large amount of debris 779 has accumulated in the cavity 713 within the obstruction relief tool 750 and just above the tool 707. The build-up of debris 779 forms an obstruction in the cavity 713 that prevents fluid 778 (e.g., completion fluid) from reaching the tool 707, which can reduce or prevent the operational viability of the tool 707. The example obstruction relief tool 750 can bypass, reduce, or eliminate the debris 779, allowing the fluid 778 to reach the tool 707 at a proper flow rate to allow the tool 707 to operate properly and the field operation to proceed.

In this case, the obstruction relief tool 750 provides a bypass for the fluid 778 around the obstruction in the cavity 713 caused by the debris 779. The example obstruction relief tool 750 can have any of a number of configurations for providing a bypass for the fluid 778 around some or all of the debris 779, thereby allowing the fluid 778 to reach the tool 707. For example, the obstruction relief tool 750 of the assembly 799 of FIG. 7 can include a base cylinder 754 (e.g., a mandrel 754) formed by a wall 751, a housing 785-1 that extends along a portion of the length of the wall 751 at the proximal end of the mandrel 754, another housing 785-2 that extends along a portion of the length of the wall 751 at the distal end of the mandrel 754, and a bypass line 786 disposed between the housings 785.

The housing 785-1 has one or more housing walls 782-1 that abuts against the wall 751 of the mandrel 754 to form at least one chamber 770-1. Similarly, the housing 785-1 has one or more housing walls 782-2 that abuts against the wall 751 of the mandrel 754 to form at least one chamber 770-3. In this case, there is a single chamber 770-1 within the housing 785-1, and there is a single chamber 770-3 within the housing 785-2. Chamber 770-1 is disposed within the housing 785-1 at the proximal end (furthest away from the tool 707) of the mandrel 754. Chamber 770-3 is disposed within the housing 785-2 at the distal end (closest to the tool 707) of the mandrel 754. Chamber 770-2 is disposed within the bypass line 786, which is coupled at its proximal end to housing 785-1 and at its distal end to housing 785-2.

In certain example embodiments, each of these chambers 770 is pressurized at atmospheric pressure. As a result, the chambers 770 are pressurized are at a relatively low pressure compared to the relatively high hydrostatic pressure caused by the fluid 778 as a result of the debris 779 that has accumulated in the cavity 713. Consequently, when the pressure in the cavity 713 is high enough, the fluid 778 actuates the actuation device 780-1 in an effort to equalize the pressure in the chamber 770-1.

In alternative embodiments, one or more of the chambers 770 (e.g., chamber 770-1) can be charged (pressurized) using a gas (e.g., nitrogen) at a different pressure (e.g., a greater pressure) relative to atmospheric pressure. In such cases, a chamber 770 can be charged using an optional injection port 729 disposed in a wall 782 of a housing 785. For example, as shown in FIG. 7, optional injection port 729-1 is disposed in the wall 782-1 of the housing 785-1 adjacent to chamber 770-1, and optional injection port 729-2 is disposed in the wall 782-2 of the housing 785-2 adjacent to chamber 770-3. As a result, the one or more chambers 770 (e.g., chamber 770-1, chamber 770-3) that are charged (e.g., pressurized to 4000 psi) can lessen the differential pressure between the pressure in the chambers 770 and the hydrostatic pressure caused by the fluid 778 as a result of the debris 779 that has accumulated in the cavity 713. This higher pressure in the chambers 770 allows the assembly 799 to be placed at greater depths within the wellbore 120 to bypass and/or clear the debris 779. When the pressure in the cavity 713 is high enough, the fluid 778 actuates an actuation device (e.g., actuation device 780-1, actuation device 780-4) in an effort to equalize the pressure in the associated chamber (e.g., chamber 770-1, chamber 770-3).

In other alternative embodiments, a vacuum can be created in one or more of the chambers 770 using one or more of the injection ports 729. In still other alternative embodiments, one or more of the chambers 770 can have one or more optional cartridges 731 disposed therein, where each optional cartridge 731 is configured to release a gas (e.g., nitrogen) when a triggering event (e.g., a change in pressure in the chamber 770, receipt of an electrical signal, the passage of time) occurs. When the gas is released from the cartridge 731, the gas travels into the cavity 713. When this occurs below or within the congestion in the cavity 713, then the pressure introduced into the cavity 713 from the gas can be greater than the hydrostatic pressure. As a result, the gas in the cavity 713 may loosen some or all of the debris 779. When one or more cartridges 731 are used in a chamber 770, the injection port 729 associated with that chamber 770 can be omitted. In this example, an optional cartridge 731 is shown in chamber 770-1. In alternative embodiments, a cartridge 731 can additionally or alternatively be placed in chamber 770-2 and/or chamber 770-3.

The outer wall 751 of the mandrel 754 can include one or more apertures (hidden from view in FIG. 7 by the actuation devices 780) that traverse therethrough. In this case, there are two apertures in the outer wall 751 that are covered by actuation device 780-1 and actuation device 780-4, respectively, when the obstruction relief tool 750 is in a disengaged state. There is also an actuation device 780-2 that covers/fills the transition between chamber 770-1 and chamber 770-2 at the proximal end of the bypass line 786 when the obstruction relief tool 750 is in a disengaged state, and there is an actuation device 780-3 that covers/fills the transition between chamber 770-2 and chamber 770-3 at the distal end of the bypass line 786 when the obstruction relief tool 750 is in a disengaged state.

One aperture is located between chamber 770-1 and the cavity 713, a second aperture is located between chamber 770-1 and chamber 770-2, a third aperture is located between chamber 770-2 and chamber 770-3, and a fourth aperture is located between chamber 770-3 and the cavity 713. As shown in FIG. 7, each aperture is covered by or filled with an actuation device 780 when the obstruction relief tool 750 is in a deactivated state. Each actuation device 780 can be any type of device that becomes removable (e.g., breaks apart, slides away, opens) in some way so that the corresponding aperture 786 goes from being covered or filled in to being open when the actuation device 780 actuates.

When an actuation device 780 actuates, the change in state of the actuation device 780 can be permanent or temporary. An example of an actuation device 780 is a rupture disc. Another example of an actuation device 780 is a communication port. Yet another example of an actuation device 780 is a knock-off plug. An actuation device 780 can change state based on a physical change (e.g., a change in pressure within the cavity 713, a difference in pressure between the cavity 713 and chamber 770-1) and/or a command (e.g., an electrical signal sent by a controller, such as controller 804 of FIG. 8 below).

When the actuation device 780-1 actuates, starting the actuation process for the obstruction relief tool 750, some of the fluid 778 in the cavity 713 above the debris 779 (at the proximal end of the obstruction relief tool 750) flows through the resulting aperture and into the chamber 770-1. When enough fluid 778 flows into the chamber 770-1, the fluid 778 forces actuation device 780-2, located at the junction between chamber 770-1 and chamber 770-2, to actuate. When this occurs, the corresponding aperture opens, allowing the fluid 778 to flow from chamber 770-1 to chamber 770-2. Subsequently, as the fluid 778 flows along chamber 770-2 (the bypass line), the fluid 786 can force actuation device 780-3, located at the junction between chamber 770-2 and chamber 770-3, to actuate. When this occurs, the corresponding aperture opens, allowing the fluid 778 to flow from chamber 770-2 to chamber 770-3. Subsequently, as the fluid 778 fills chamber 770-3, the fluid 786 can force actuation device 780-4, located at the junction between chamber 770-3 and cavity 713, to actuate. When this occurs, the corresponding aperture opens, allowing the fluid 778 to flow from chamber 770-3 to the cavity 713. In this way, obstruction relief tool 750 bypasses the fluid 778 around the obstruction caused by the debris 779 in the cavity 713, which re-establishes flow of the fluid 778 to the tool 707.

In some cases, chamber 770-1, chamber 770-2, and chamber 770-3 can be considered portions of a single chamber 770 that are physically separated from each other when the actuation device 780-2 and actuation device 780-3 are in their default conditions. When actuation device 780-2 and actuation device 780-3 are actuated, chamber 770-1, chamber 770-2, and chamber 770-3 can be considered portions of a single continuous chamber 770.

Figure 8:
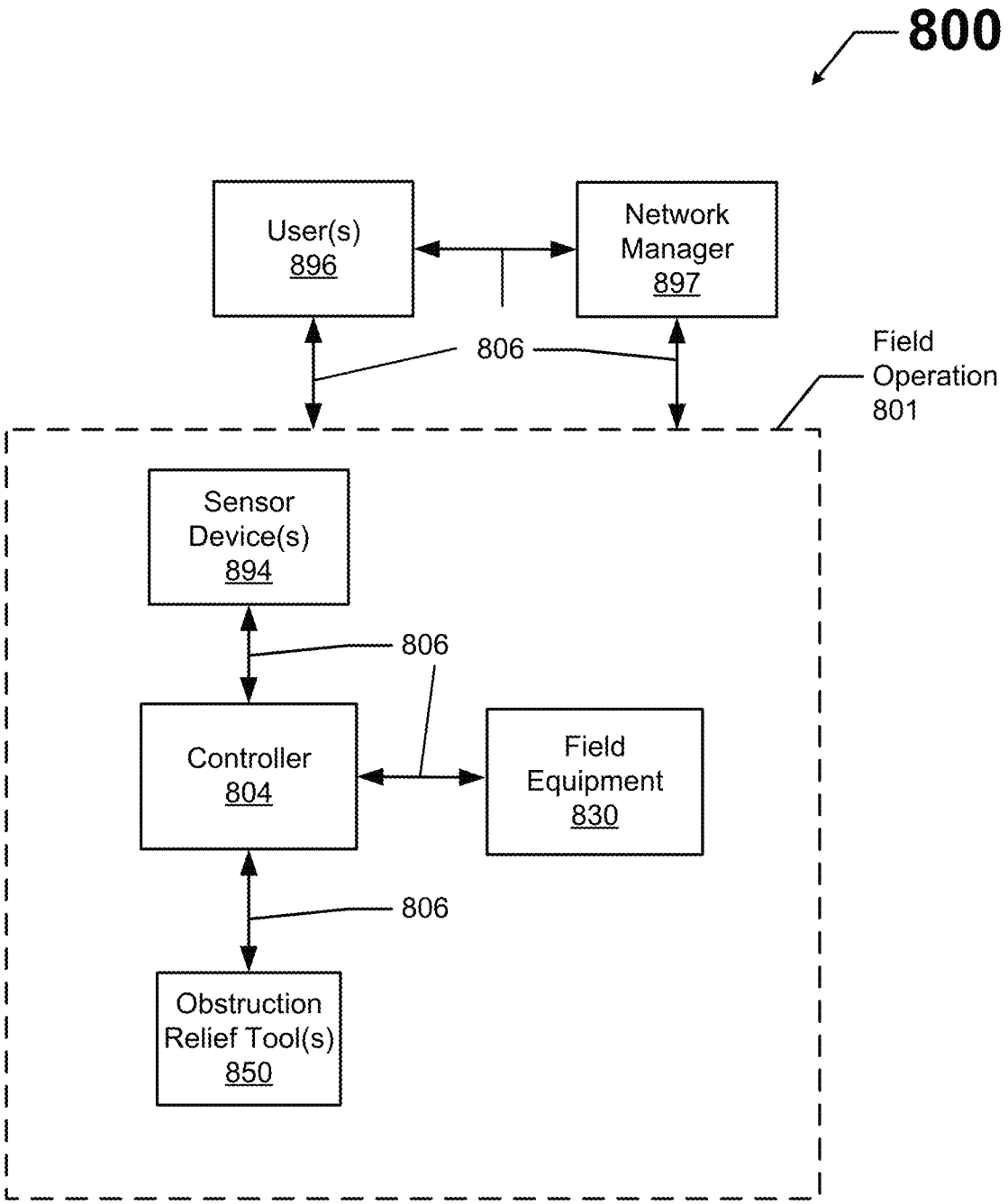
FIG. 8 shows a system diagram of a system in accordance with certain example embodiments.

FIG. 8 shows a system diagram of a system 800 in accordance with certain example embodiments. Referring to FIGS. 1 through 8, the system 800 can include one or more components. For example, as shown in FIG. 8, the system 800 can include one or more sensor devices 894 (also sometimes called sensor modules 860), one or more users 896, a network manager 897, a controller 804, field equipment 830, and one or more obstruction relief tools 850. The users 896, the field equipment 830, and the obstruction relief tools 850 are substantially the same as the users, the field equipment, and the example obstruction relief tools discussed above. The sensor devices 894, the controller 804, the field equipment 830, and the obstruction relief tool 850 can be part of a field operation 801.

The network manager 897 is a device or component that controls all or a portion of the system 800 that includes the controller 804. The network manager 897 can be substantially similar to the controller 804 in terms of components and/or functionality. Alternatively, the network manager 897 can include one or more of a number of features in addition to, or altered from, the features of the controller 804. There can be more than one network manager 897 and/or one or more portions of a network manager 897. In some cases, a network manager 897 can be called by a number of other names known in the art, including but not limited to an insight manager, a master controller, a network controller, and a gateway.

The various components of the system 800 can communicate with each other using communication links 806. Each communication link 806 can include wired (e.g., Class 1 electrical cables, Class 2 electrical cables, electrical connectors, Power Line Carrier, RS485) and/or wireless (e.g., Wi-Fi, visible light communication, cellular networking, Bluetooth, Bluetooth Low Energy (BLE), ultra-wideband (UWB), Zigbee, fluid wave communication) technology. The communication links 806 can transmit signals (e.g., power signals, communication signals, control signals, data) between two or more components of the system 800. For example, the controller 804 of the system 800 can interact with the obstruction relief tool 850 by transmitting communication signals (e.g., instructions, data, control) over one or more communication links 806.

The communication signals transmitted over the communication links 806 are made up of bits of data. As described herein, the communication signals can be one or more of any type of signal, including but not limited to RF signals, infrared signals, visible light communication, pressure waves (through the fluid in the wellbore), and sound waves. In some cases, communication links 806 between the controller 804 and the obstruction relief tool 850 can include, but are not limited to, the casing string (e.g., casing string 124), the tubing string (e.g., tubing string 114), an electrical cable, and fluid circulated down the cavity of the tubing string and up the annulus within the wellbore.

Each of the one or more sensor devices 894 can include any type of sensing device that measures one or more parameters. Examples of types of sensors of a sensor device 894 can include, but are not limited to, a pressure sensor, a passive infrared sensor, a photocell, an air flow monitor, a gas detector, a fluid analyzer, a hydrocarbon analyzer, and a temperature detector. Examples of a parameter that is measured by a sensor of a sensor device 894 can include, but are not limited to, pressure in the wellbore (e.g., wellbore 120), a temperature, a level of gas, a level of humidity, contents of fluid, and a pressure wave.

In some cases, the parameter or parameters measured by a sensor device 894 can be used by the controller 804 to operate the field equipment 830 and/or a portion (e.g., a valve, an actuator, a shearing device) of the obstruction relief tool 850. A sensor device 894 can be an integrated sensor. An integrated sensor has both the ability to sense and measure at least one parameter and the ability to communicate with another component (e.g., the controller 804) of the system 800. The communication capability of a sensor device 894 that is an integrated sensor can include one or more communication devices that are configured to communicate with one or more other components of the system 800.

In some cases, an integrated sensor device 894 can include more than one transmitter and/or more than one receiver. This would allow the integrated sensor device 894 to broadcast to multiple components of the system 800 using different communication protocols and/or technology. Each sensor device 894 can use one or more of a number of communication protocols. This allows a sensor device 894 to communicate with one or more components of the system 800. The communication capability of a sensor device 894 that is an integrated sensor can be dedicated to the sensor device 894 and/or shared with the controller 804. When the system 800 includes multiple integrated sensor devices 894, one integrated sensor device 894 can communicate, directly or indirectly, with one or more of the other integrated sensor devices 894 in the system 800.

If the communication capability of a sensor device 894 that is an integrated sensor is dedicated to the sensor device 894, then the sensor device 894 can include one or more components (e.g., a transceiver, a communication module), or portions thereof, that are substantially similar to the corresponding components described below with respect to the controller 804. In certain example embodiments, a sensor device 894 can include an energy storage device (e.g., a battery) that is used to provide power, at least in part, to some or all of the other components of the sensor device 894. The optional energy storage device of the sensor module 894 can operate at all times or when the main source of power supplying the sensor device 894 is interrupted.

Further, a sensor device 894 can utilize or include one or more components (e.g., memory, storage repository, transceiver) found in the controller 804. In such a case, the controller 804 can provide the functionality of these components used by the sensor device 894. Alternatively, the sensor device 894 can include, either on its own or in shared responsibility with the controller 804, one or more of the components of the controller 804. In such a case, the sensor device 894 can correspond to a computer system as described below with regard to FIG. 9.

The controller 804 of the system 800 can include one or more of a number of components. Such components, can include, but are not limited to, a control engine, a communication module, a timer, a power module, a storage repository (for storing items such as, but not limited to, protocols, algorithms, threshold values, tables, user preferences, settings, historical data, forecasts, and instructions), a hardware processor, a memory, a transceiver, an application interface, and a security module. The controller 804 can correspond to a computer system as described below with regard to FIG. 9.

The controller 804 can be a stand-alone component of the system 800. Alternatively, the controller 804 can be integrated with another component (e.g., the obstruction relief tool 850, field equipment 830, such as a drive motor for pumps that pump the fluid, such as fluid 478 in FIGS. 4A through 4C, downhole) of the system 800. In such a case, for example, a sensor device 894 in the form of a downhole pressure sensor can detect and communicate a change in pressure that results from events such as the actuation of an actuation device (e.g., actuation device 480) and relieving and/or bypassing an obstruction caused by debris (e.g., debris 479).

As an example, one or more sensor devices 894 can be integrated with the obstruction relief tool 850. In such a case, the one or more sensor devices 894 can measure a pressure toward the top or proximal end of the obstruction relief tool 850 as well as a pressure toward the bottom or distal end of the obstruction relief tool 850. These pressure measurements can be communicated, using the communication links 806, to the controller 804. The controller 804 can then determine if the differential pressure exceeds a threshold value, indicating that there is congestion (e.g., caused by debris) within the cavity of the obstruction relief tool 850. When the threshold value has been exceeded, the controller 804 can actuate one or more actuation devices in the obstruction relief tool 850 and employ the obstruction relief tool 850 to relieve the obstruction.

Figure 9:
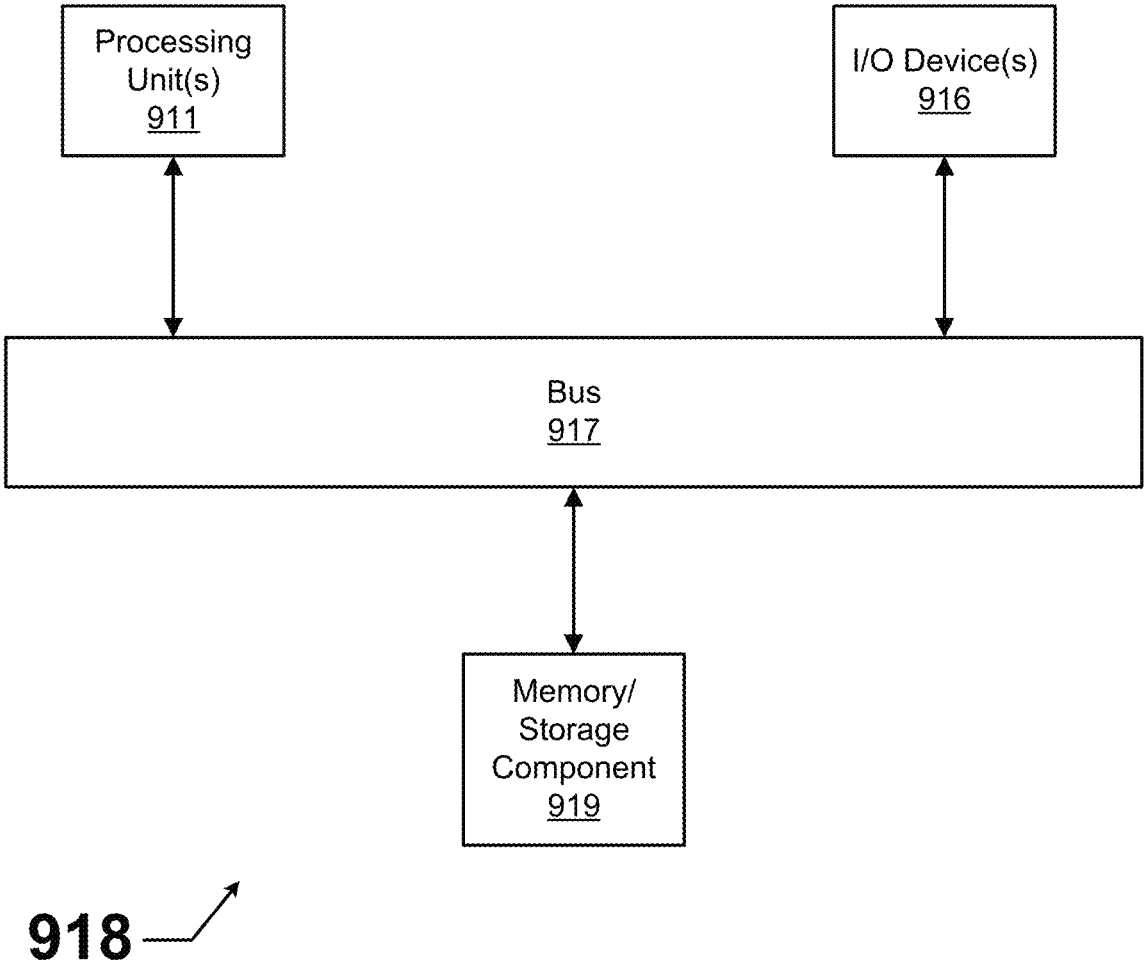
FIG. 9 shows a computing device in accordance with certain example embodiments.

FIG. 9 illustrates one embodiment of a computing device 918 that implements one or more of the various techniques described herein, and which is representative, in whole or in part, of the elements described herein pursuant to certain exemplary embodiments. For example, computing device 918 can be implemented in the controller 804 of FIG. 8 in the form of a hardware processor, memory, and a storage repository, among other components. Computing device 918 is one example of a computing device and is not intended to suggest any limitation as to scope of use or functionality of the computing device and/or its possible architectures. Neither should computing device 918 be interpreted as having any dependency or requirement relating to any one or combination of components illustrated in the example computing device 918.

Computing device 918 includes one or more processors or processing units 911, one or more memory/storage components 915, one or more input/output (I/O) devices 916, and a bus 917 that allows the various components and devices to communicate with one another. Bus 917 represents one or more of any of several types of bus structures, including a memory bus or memory controller, a peripheral bus, an accelerated graphics port, and a processor or local bus using any of a variety of bus architectures. Bus 917 includes wired and/or wireless buses.

Memory/storage component 915 represents one or more computer storage media. Memory/storage component 915 includes volatile media (such as random access memory (RAM)) and/or nonvolatile media (such as read only memory (ROM), flash memory, optical disks, magnetic disks, and so forth). Memory/storage component 915 includes fixed media (e.g., RAM, ROM, a fixed hard drive, etc.) as well as removable media (e.g., a Flash memory drive, a removable hard drive, an optical disk, and so forth).

One or more I/O devices 916 allow a customer, utility, or other user to enter commands and information to computing device 918, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 918 is connected to a network (not shown) (e.g., a LAN, a WAN such as the Internet, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 919 includes at least the minimal processing, input, and/or output means necessary to practice one or more embodiments.

Further, those skilled in the art will appreciate that one or more elements of the aforementioned computer device 918 is located at a remote location and connected to the other elements over a network in certain exemplary embodiments. Further, one or more embodiments is implemented on a distributed system having one or more nodes, where each portion of the implementation (e.g., control engine) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

The systems, methods, and apparatuses described herein allow for relieving obstructions caused by debris during a field operation in a subterranean formation. Example embodiments can remove some or all of the debris. In addition, or in the alternative, example embodiments can bypass the debris. Example embodiments are part of the wellbore assembly, but do not affect the operations being performed in the wellbore. Example embodiments can be controlled mechanically, hydraulically, electrically, and/or wirelessly. Example embodiments are designed to comply with applicable industry standards.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An obstruction relief tool comprising:

a plurality of walls comprising an inner wall, wherein the inner wall of the plurality of walls forms a cavity along a length of the inner wall;

a chamber disposed between the plurality of walls, wherein the chamber has a proximal end and a distal end; and an actuation device that is configured to actuate when an obstruction is within the cavity, wherein the actuation device fills a first aperture in the inner wall that leads to the proximal end of the chamber when the actuation device is in an unactuated state, wherein the actuation device, when actuated, is configured to open the first aperture in the inner wall that leads to the proximal end of the chamber, wherein the distal end of the chamber leads to a second aperture in the inner wall, wherein the first aperture is adjacent to the cavity above the obstruction, and wherein the second aperture in the inner wall is adjacent to the cavity below the obstruction.

2. The obstruction relief tool of claim 1, further comprising a piston and a second chamber, wherein the chamber and the second chamber are initially set at an atmospheric pressure, wherein the piston moves, when the fluid fills the chamber, from a first position to a second position to uncover at least one channel between the cavity and the second chamber, and wherein the channel is located adjacent to the obstruction.

3. The obstruction relief tool of claim 2, wherein the piston, upon moving from the first position to the second position, further uncovers a second channel in an outer wall of the plurality of walls, wherein the outer wall forms the chamber.

4. The obstruction relief tool of claim 2, further comprising a bypass chamber that is configured to combine with the chamber when the piston moves to the second position.

5. The obstruction relief tool of claim 2, further comprising a distal stop that limits a distance of travel of the piston to the second position away from the first position.

6. The obstruction relief tool of claim 5, wherein the distal stop is located in the second chamber.

7. The obstruction relief tool of claim 5, further comprising a second distal stop that further limits the distance of travel of the piston to the second position away from the first position.

8. The obstruction relief tool of claim 2, further comprising a proximal stop that limits a distance of travel of the piston toward the first position away from the second position.

9. The obstruction relief tool of claim 8, wherein the proximal stop is located in the at least one chamber.

10. The obstruction relief tool of claim 8, wherein the proximal stop is adjustable.

11. The obstruction relief tool of claim 2, wherein the chamber is physically separated into a first portion and a second portion by the piston when the piston is in the first position, and wherein the first portion and the second portion of the chamber are configured to be continuous when the piston is in the second position.

12. The obstruction relief tool of claim 1, wherein the chamber is physically separated into a first portion and a second portion by a second actuation device, and wherein the first portion and the second portion of the chamber are configured to be continuous when the second actuation device is actuated.

13. The obstruction relief tool of claim 1, wherein the second aperture is filled by a second actuation device, wherein the second aperture is opened when the second actuation device is actuated.

14. The obstruction relief tool of claim 1, wherein the actuation device comprises a rupture disc.

15. The obstruction relief tool of claim 1, wherein the actuation device is triggered electronically or hydraulically.

16. The obstruction relief tool of claim 1, further comprising an injection port disposed in an outer wall of the plurality of walls adjacent to the chamber, wherein the injection port is configured to facilitate pressurization of the chamber.

17. The obstruction relief tool of claim 1, further comprising a cartridge disposed in the chamber, wherein the cartridge is configured to release a gas into the chamber to clear the obstruction.

18. A method for delivering a fluid to a tool below an obstruction in a cavity of a tubing string in a subterranean wellbore, the method comprising:

actuating, upon the presence of the obstruction within the cavity of an obstruction relief tool, an actuation device of the obstruction relief tool integrated with the tubing string, wherein actuating the actuation device opens a flowpath for the fluid from the cavity through a first aperture at a proximal end of the obstruction relief tool, through a chamber, and through a second aperture at a distal end of the obstruction relief tool into the cavity for the tool, wherein the first aperture is above the obstruction, and wherein the second aperture is below the obstruction, wherein the actuation device fills the first aperture when the actuation device is in an unactuated state, and wherein the actuation device, when actuated, is configured to open the first aperture.

19. The method of claim 18, further comprising:

actuating, after the fluid enters the chamber, a second actuation device of the obstruction relief tool to open the second aperture.

20. An assembly disposed within a subterranean wellbore, the assembly comprising:

a tool; and an obstruction relief tool coupled to a tube pipe of a tubing string, wherein the obstruction relief tool, when enabled, relieves an obstruction in a cavity in the obstruction relief tool to provide a fluid to the tool, wherein the obstruction affects flow of the fluid through the cavity to the tool, wherein the tool is disposed below the obstruction relief tool in the subterranean wellbor$_e$z and wherein the obstruction relief tool comprises:

a plurality of walls comprising an inner wall, wherein the inner wall of the plurality of walls forms the cavity along a length of the inner wall;

a chamber disposed between the plurality of walls, wherein the chamber has a proximal end and a distal end; and an actuation device that is configured to actuate when the obstruction is within the cavity, wherein the actuation device fills a first aperture in the inner wall that leads to the proximal end of the chamber when the actuation device is in an unactuated state, wherein the actuation device, when actuated, is configured to open the first aperture, wherein the distal end of the chamber leads to a second aperture in the inner wall, wherein the first aperture is adjacent to the cavity above the obstruction, and wherein the second aperture in the inner wall is adjacent to the cavity below the obstruction.

* * * * *